US005096262A

United States Patent [19]

Foullois

[11] Patent Number: 5,096,262

[45] Date of Patent: Mar. 17, 1992

[54] DEVICE FOR ENLARGING A CHIMNEY

[76] Inventor: Bernhard Foullois, Bredenbek, D-2323 Nehmten, Fed. Rep. of Germany

[21] Appl. No.: 457,804

[22] PCT Filed: Mar. 13, 1989

[86] PCT No.: PCT/EP89/00265

§ 371 Date: Jan. 12, 1990

§ 102(e) Date: Jan. 12, 1990

[87] PCT Pub. No.: WO89/08802

PCT Pub. Date: Sep. 21, 1989

[30] Foreign Application Priority Data

Mar. 12, 1988 [DE] Fed. Rep. of Germany ..... 3808376

[51] Int. Cl.[5] ..... B08B 9/02; B28D 1/18; F23J 3/02

[52] U.S. Cl. ..... 299/55; 15/243; 29/81.05; 241/277; 299/90

[58] Field of Search ..... 299/10, 55, 62, 89, 299/90; 166/241; 15/242, 243, 163, 164; 29/81.021, 81.05; 241/101.2, 101.7, 277, 282.1, 282.2

[56] References Cited

U.S. PATENT DOCUMENTS

| | | | |
|---|---|---|---|
| 1,293,777 | 2/1919 | Hogue | 15/243 X |
| 1,558,596 | 10/1925 | De Fontaine | 175/263 |
| 1,569,203 | 1/1926 | Rice et al. | 15/243 X |
| 1,592,268 | 7/1926 | Hill . | |
| 1,899,727 | 2/1933 | Sandstone . | |
| 2,095,725 | 10/1937 | Whealy . | |
| 2,175,406 | 10/1939 | Osborn . | |
| 2,232,018 | 2/1941 | Wright . | |
| 2,275,939 | 3/1942 | Baker . | |
| 2,497,659 | 2/1950 | Davis . | |
| 2,641,791 | 6/1953 | Wells | 15/243 X |
| 2,889,612 | 6/1959 | Joosepson . | |
| 2,937,008 | 5/1960 | Whittle . | |
| 3,480,092 | 11/1969 | Reinold | 175/19 |
| 3,562,836 | 6/1971 | McGee . | |
| 3,669,199 | 6/1972 | Cullen et al. | 175/106 |
| 4,222,445 | 9/1980 | Vadetsky et al. | 175/106 |
| 4,509,701 | 4/1985 | Jack et al. | 15/163 X |
| 4,520,524 | 6/1985 | Long . | |
| 4,603,747 | 8/1986 | Golden . | |
| 4,678,045 | 7/1987 | Lyons | 175/61 |

FOREIGN PATENT DOCUMENTS

| | | | |
|---|---|---|---|
| 203707 | 6/1959 | Austria . | |
| 325290 | 10/1975 | Austria . | |
| 232019 | 4/1987 | Czechoslovakia . | |
| 274605 | 5/1914 | Fed. Rep. of Germany . | |
| 1175379 | 8/1964 | Fed. Rep. of Germany . | |
| 1229230 | 11/1966 | Fed. Rep. of Germany . | |
| 1807351 | 7/1969 | Fed. Rep. of Germany . | |
| 3009013 | 9/1981 | Fed. Rep. of Germany . | |
| 3015381 | 10/1981 | Fed. Rep. of Germany . | |
| 2953685 | 1/1982 | Fed. Rep. of Germany . | |
| 8701745 | 3/1987 | Fed. Rep. of Germany . | |
| 8626492 | 5/1987 | Fed. Rep. of Germany . | |
| 262073 | 11/1988 | Fed. Rep. of Germany | 15/242 |
| 262467 | 11/1988 | Fed. Rep. of Germany . | |
| 569632 | 4/1924 | France . | |
| 1571793 | 6/1969 | France . | |
| 2074527 | 10/1971 | France . | |
| 86/00391 | 1/1986 | PCT Int'l Appl. . | |
| 177343 | 11/1961 | Sweden . | |
| 177783 | 1/1962 | Sweden . | |

*Primary Examiner*—David J. Bagnell
*Attorney, Agent, or Firm*—Spencer & Frank

[57] ABSTRACT

An apparatus for cross-sectionally enlarging a chimney flue includes a fluid motor; a milling cutter mounted on the fluid motor and being driven thereby for removing constructional wall material from walls defining the flue; a suspension device for supporting the fluid motor and the milling cutter as a unit and for raising and lowering the fluid motor and the milling cutter in the chimney flue; a fluid pressure source; a hose connecting the fluid pressure source with the fluid motor for supplying the fluid motor with pressurized fluid from the fluid pressure source; a guiding device arranged about and travelling with the fluid motor for engaging the flue walls to guide the fluid motor in the flue; and a device for varying a radial position of the guiding device relative to the motor axis.

61 Claims, 17 Drawing Sheets

122
156
148
162
148
147
148
154
160
150
150
154
158
126
110
48
146
146
138
152
138
138
136
134
140
134
128
152
140
140
136
140
104
144
84
142
142
144
178
134
92
144
144
138
12
128
134
138
138
140
136
140
86
136
140
80
146
142
146
124
140
146
142

DEVICE FOR ENLARGING A CHIMNEY

BACKGROUND OF THE INVENTION

The invention relates to an apparatus and method for enlarging the cross section of a chimney flue by removing wall material from the flue walls by means of a milling.

It is a constant task for chimney sweeps, boiler cleaners and other pipeline cleaning personnel to clean flue gas deposits out of exhaust gas pipes and to re-establish the original inner cross section of such pipes. This is sometimes done manually, sometimes by means of motor-driven servo supports. Even more stubborn deposits can be removed with relatively little effort so that generally brush-like cleaning tools and relatively weakly designed servo motors are sufficient. An example for cleaning flue gas pipes in a boiler system is disclosed in FR-A 2,074,527. In this prior art device, a cleaning brush is introduced into the boiler pipe to be cleaned together with a pneumatic motor driven by compressed air. The device here does not operate in the manner of a milling device but in the manner of a radial grinder (see also DE-A1 2,953,685 which works with a scrub brush).

Much more difficult is the cleaning of chimneys in old buildings in need of restoration. This is what the invention relates to exclusively.

The need for restoration may here have very different reasons. Thus, only as an example, the original pipe for carrying the flue gas may have become inoperable due to soot deposits, cracks, brittleness, permeability to flue gases, loss of thermal insulation or insufficient thermal insulation according to recent evaluations, or for other reasons. Or the inner lining layer that had been introduced in a first attempt at restoration may have been or become useless. Finally, in still properly operating chimney structures, a change in the inner cross section may be desired. In all these cases, a new inner pipe (called lining) for carrying the flue gas must be drawn into the chimney requiring the restoration, in certain cases so as to provide an additional radial space outside of this inner pipe to be drawn in, be it because of the necessity of introducing a thermal insulation layer at the same time, be it in order to provide space for some other purpose, for example for ventilation. Now the new inner pipe for carrying the flue gas must have a predetermined inner and thus also an outer diameter whose order of magnitude is predetermined, so that generally it is impossible to draw a new inner pipe for restoration into the already existing inner diameter of the chimney requiring the restoration. Therefore, it is necessary in all these cases to remove at least the present inner flue gas shell in the chimney requiring restoration before restoration pipe elements are inserted. In many cases of multi-shell chimney construction, the entire original inner flue gas carrying pipe will have to be removed. In other cases, as in the above-mentioned example of further restoration after a prior, failed restoration attempt, it may suffice to remove a centrifuged layer or the like, possibly together with edge zones of the original chimney structure.

Moreover, the materials of the interior pipes of existing chimneys and of the layers requiring restoration and being included therein are very different and almost always very resistant. Only as an example, older chimneys are constructed from natural or artificial stone, e.g. certain bricks, or are molded of concrete as single-shell molded pieces, particularly from concrete having thermal insulation properties. In more recent chimney constructions, the flue gas carrying interior pipes are often made of different quality fire clays up to glass, ceramic and high-grade steel pipes. In older chimneys, the lining of the inner pipe has also been formed of component similar to ceramic tiles.

Additionally, chimneys are not infrequently set in sections onto floor breakthroughs so that, for example, actual structural material such as, for example, concrete from floors or ceilings of rooms and reinforcement elements embedded therein, including iron reinforcements extend into the inner cross section of the flue gas carrying pipe in the region of the floor and often even form cross-sectional constrictions there. Corresponding cross-sectional constrictions are also frequently found if mortar work during the installation of the original chimney was not done very neatly.

Finally it has been found that quite a considerable percentage of the chimneys requiring restoration do not extend along a precisely vertical axis but, in individual cases, often exhibit surprising curvatures and crooked offsets.

It has already been considered to produce the required enlargement of the cross section of a chimney requiring restoration by means of a drill (reference numeral 6 in DE-U1 87 01 745.8; see also reference numeral 12 in DE-U1 86 26 492.3). However, drilling out chimneys is possible only if the inner layer is made of certain materials and is additionally undesirable because the chimney structure is subjected to uncontrollable pressure influences. The only thing in favor of drilling is a relatively favorable operating speed.

Less stress on the chimney structure is realized with grinding. This, however, is connected with a considerable amount of time. If, moreover, the rotary grinding tools employed are those equipped with flying chains as disclosed in SE-C 177,343 or SE-C 177,783, there additionally occur washboard-like groove formations at the interior surface of the chimney. This applies also if these flying chains are arranged as taught in WO 86 00 391 issued by WIPO in immediately axially successive planes of the rotary tool; this merely makes the washboard effect more compact.

If a milling cutter is employed, however, the existing chimney structure is treated gently and a high operating speed can be realized. This is connected with tool geometries that can be employed in greater multitudes and thus there is better adaptability, on the one hand, to existing conditions and, on the other hand, to the work goal.

In addition to the stated methods of widening the inner width of a chimney in need of restoration by drilling, grinding or milling, it is also known to provide a tool which performs a hammering action. Thus, U.S. Pat. No. 4,603,747 discloses a rotating vibratory hammer. However, such a hammer is suitable only for special cases, here to chip off the tiles serving as the inner lining of the flue gas pipe.

Finally, it is known to cause a rotary tool for widening the inner cross section of a chimney requiring restoration to perform axial striking oscillations by way of a striking mechanism. This also, however, leads to undesirable shocks to the chimney structure (AT-A 325,290).

The invention is based on AT-A 203,707 in which, in addition to the use of grinding or hammering tools, milling cutters have also been considered. The respective grinding tool or milling cutter in this prior art device together with its drive motor can be moved up and down chimney flue.

The invention prefers the use of actual milling cutters. Insofar as the term milling cutters is used here, they may also be replaced, particularly for special applications or additional process steps, by drilling or grinding tools which are included in the term material removing tools.

This prior art device differs from more remote devices in which the drive motor is disposed outside of the chimney and torque is transmitted into the interior of the chimney by way of a possibly flexible shaft (see DE-A 1,229,230, WO 86/00391 issued by WIPO).

Due to the limited length available for the torque transmitting shaft in such devices, the drive must be accommodated on the roof, with a range greater than about 10 meters being possible only by the further coupling in of flexible extension shafts and a loss of power. In this connection, it has been found to be possible to start the drive motor only if a tool is used to remove the end piece of the shaft from the chimney. The flexible shaft and the tool thus move out in the open and constitute a grave danger for the operating personnel Moreover, the shafts and their connecting couplings quickly wear out in operation and additionally tend to break suddenly. Generally, their manipulation is fraught with problems. Use in chimneys that are not axially linear is possible only very conditionally.

However, AT-A 203,707 provides an electric motor drive. In a preferred embodiment of this prior art device, the stator of the electric motor simultaneously serves as a guide for the motor along the interior wall of the chimney. In all disclosed embodiments, the amount of apparatus required and the minimum diameter of the device connected therewith is so large that the device does not appear to be suitable for drilling chimneys having a rated diameter of less than 150 mm. And it appears to be particularly impossible to pass such a device through the inner cross section of a chimney of this rated diameter in order to then mill from the bottom to the top when there are additional interior deposits.

Moreover, electric motor drives do not appear suitable at all for introduction into a chimney. Only as examples, reference shall be made to the danger of explosion in deposited soot if a spark is generated, the danger of electrical short circuits at conductive regions of the interior wall of the chimney (e.g. projecting metal reinforcements or due to soot deposits on regions that have become conductive due to the presence of liquids), the danger of combustion due to the motor running hot because of insufficient ventilation if the additional space requirement for liquid cooling is avoided, the danger of an accident to operating personnel. the heavy operating weight, the infrequent availability of heavy current at the work location and the like. Additionally, milling cutters driven by electric motors tend to seize up in the masonry even if, as in the case of the above-mentioned AT-A 203,707, counteracting decoupling devices are provided. Further, a sensitive infinite regulation is possible only with difficulties. Finally, the entire apparatus completely covers the viewing cross section of the chimney so that direct observation of the milling process from the upper chimney opening is impossible. Viewing from below is out of the question, primarily because of the dropping down of material loosened by the milling.

Inasmuch as can be determined, electric motors lowered into the chimney together with the milling cutter have not found acceptance in practice, probably for the reasons mentioned above. Not without reason is the electric motor disclosed and employed in the case of WO 86/00391 issued by WIPO also disposed outside of the chimney and the costs of connecting this electric motor by way of flexible rod assemblies with the rotary tool, in this case a chain grinder, disposed in the interior of the chimney are considered inevitable.

SUMMARY OF THE INVENTION

Based on AT-A 203,707, it is an object of the invention to provide an improved device of the above-outlined type which is usable without danger, comfortably and universally while maintaining as many of the advantages of the prior art device as possible and which has a compact configuration permitting an optical inspection of the work location of the milling cutter from the top.

This object and others to become apparent as the specification progresses, are accomplished by the invention, according to which, briefly stated. the apparatus for cross-sectionally enlarging a chimney flue includes a fluid motor; a milling cutter mounted on the fluid motor and being driven thereby for removing constructional wall material from walls defining the flue; a suspension device for supporting the fluid motor and the milling cutter as a unit and for raising and lowering the fluid motor and the milling cutter in the chimney flue; a fluid pressure source; a hose connecting the fluid pressure source with the fluid motor for supplying the fluid motor with pressurized fluid from the fluid pressure source; a guiding device arranged about and travelling with the fluid motor for engaging the flue walls to guide the fluid motor in the flue; and a device for varying a radial position of the guiding device relative to the motor axis.

The fluid motor employed in the apparatus according to the invention may be operated, for example, with oil or with compressed air. In the case of compressed air or some other pneumatic gas, for example an inert gas such as nitrogen, no danger exists for the chimney from the start. Hydraulic oils are advisably selected to be of a non-flammable type. If such a hydraulic oil should escape into a soot-filled chimney, it could even happen that the oil entered a liquid bond with the soot, resulting in a reduction of the original danger of soot combustion Moreover, fluid conduits have less of a tendency than electrical lines to be caught at projections and in grooves on the interior surface of the chimney to be milled out.

Of particular significance is the possibility of building the fluid motor with such a small diameter that it can be introduced into the chimney even if the chimney has a very small inner diameter. Even with a relatively short axial structural length, it is then possible to transmit a very high torque which, with suitable selection of interchangeable milling cutters, is applicable for all existing wall materials of a chimney to be milled out.

A small diameter and small axial structure can easily be combined into an overall compact structure particularly for fluid motors. This has quite a number of advantages, such as light weight and thus easy attainability of even very great working depths, sufficient optical viewing space to observe the work location of the cutting tool from the top even in chimneys having a circular inner cross section and easy guidability along non-linear work paths.

Fluid motors do not require cooling in order to prevent the motor from overheating. Their internal structure is technically simple and at the same time robust. Therefore there exists no risk if the fluid motor strikes against the inner wall surface of the chimney even at greater working depths. It is possible to easily construct a configuration which is protected against damage even if it is dropped from a great height. The operating components can easily be shielded against the dust developed during milling, for example by means of a simple housing, particularly since the components of a fluid motor in any case exhibit a narrow, elongate structure which is suitable for chimneys. A hydraulic oil pump making available the operating fluid from outside the chimney or a compressor, in the case of a pneumatic pump, can easily be driven at any desired location by means of an internal-combustion engine, for example a modern, low-noise Diesel engine, without there being a need for a heavy-current connection.

For these reasons, the apparatus according to the invention has in the meantime found generally broad acceptance in all imaginable fields of application, while all comparable prior art devices are applicable at most under special conditions. The apparatus according to the invention is very versatile: with a suitably adapted milling cutter, the same fluid motor can be employed in all cases, i.e. even a fluid motor having a very small diameter in chimneys having the maximum width.

The apparatus according to the invention can be employed for milling interior, flue gas carrying pipes having a circular inner cross section as well as those having a noncircular, for example an approximately rectangular or square cross section. In all cases, the final cross section will be circular due to the rotating mode of operation of the milling cutter, with the cross section in non-circular cross sections being only partially carved out in the regions where the diameter is smallest.

Within the scope of the invention it is primarily intended to perform, for the reasons explained above, the actual material removal for enlarging the chimney by milling. However, drilling or grinding devices can also be attached interchangeably to the same fluid motor in order to perform, for example, preparatory work at the chimney, such as enlargement of the damper and to equalize chimney cope plateaus. It is also not excluded to employ the fluid motor according to the invention, for example, for reduced quality demands or for the use of already existing drilling and grinding tools.

The use of pneumatic oil as the operating fluid is known to offer the advantage of being able to operate independently of the path with relatively high operating pressures in the manner of a rod assembly and thus without delay. According to a further feature of the invention, however, the use of compressed air or other pneumatic gases is preferred for the present purpose of milling out a chimney to be lined. Even if a compressed air conduit should spring a leak, the leakage stream will disappear without residue as long as the pneumatic fluid does not carry any moisture components which may even be preferred according to the description below. But any moisture evaporates quickly out of a chimney.

Moreover, operation with compressed air or the like as the operating gas can be regulated very easily and infinitely from the outside of the chimney in that the pressure of the compressed air is changed by way of an adjustment valve, for example, directly at the compressor, but also where the chimney worker is located, e.g. on the roof. Due to the compressibility of a pneumatic pressure fluid, the milling cutter will run gently onto any possibly existing resistances so that the mode of operation itself indicates that the milling cutter will hardly ever be seized in the chimney.

Particularly significant is also the possibility that pneumatic motors can be built with an even smaller diameter compared to hydraulic motors acting as fluid motors.

In principle, the exhaust air (atmospheric air or other pneumatic pressure fluid) can be extracted from the chimney through a separate exhaust conduit. Preferably, however, the exhaust air is permitted to escape directly into the flue gas channel of the chimney. This creates an air cushion of a slight overpressure in this region. It has been found that a direction of flow to cause it to flow out downwardly is thus impressed on the dust developed during the milling process which, in contrast to larger dimensioned material from the milling process (that in any case tends to drop downwardly due to gravity) tends to be thrown upwardly. This is a double advantage. On the one hand, the discharge of the developed dust toward the bottom can take place in a simple manner without or with only a slight suction effort; the suction effort of an extraction device possibly provided at the lower end of the chimney can also be kept small. On the other hand, the possibility of a geometric optical viewing cross section from the top past the fluid motor in the direction toward the work location of the tool can be fully utilized by the operator since then the space above the milling cutter or above the mentioned air cushion remains free of dust clouds. A pleasant side effect is then also that the operators do not become dirty from the raised dust.

If, according to a further feature of the invention, the exhaust air discharge is positively oriented downwardly onto the milling cutter disposed below the fluid motor, the cutting tool can be cooled continuously and kept free o undesirable deposits. An air dryer in the open pneumatic circuit may then even be omitted since it has been found that moisture components in the compressed air are favorable to bind the resulting fin dust.

It is known per se to hold and guide an electric motor, which is introduced into the chimney to be restored together with a drill head, from the upper end of the chimney by way of a guide rod. Preferably, according to another feature of the invention, the unit composed of fluid motor and milling cutter is suspended from a pure traction element as disclosed per se in AT-A 203,707. In the simplest embodiment 6, the fluid hose itself may serve as the pulling element which must then advisably be equipped to be supportable. As an alternative, there is the use of a separate pulling element such as, for example, a pulling cable, e.g. of steel, operated by a winch. The hanging chain employed in AT-A 203,707 can easily be replaced by such a pulling cable due to the low weight of the fluid motor according to the invention. In spite of the relatively low weight of a unit composed of fluid motor and milling cutter, it has been found that, when milling from the top to the bottom, the weight load o the milling cutter exerted by the fluid motor and the other components of the unit composed of fluid motor and milling cutter is sufficient even if materials are involved which are very difficult to mill such as, for example, a fire-clay pipe that has to be milled away or a steel pipe that has to be milled way. The decisive factor here is the correct selection of the milling cutter. If desired, however, a pressure device can be employed within the scope of the invention to exert pressure from the top to the bottom. For example, a pressure cylinder fed by the same compressor could be provided at the upper end of the chimney to charge the pressure component with a downward force. As an alternative, a pulling action may be exerted from below in a known manner (reference numeral 15 in AT-A 203,707).

To ensure optical visibility of the milling cutter from the top alongside the fluid motor, guide elements for the fluid motor in the chimney are advisably arranged only locally around the fluid motor. In contrast thereto, in AT-A 203,707, the guide elements in question are each closed in the form of a ring.

According to a first possibility for this, the invention provides runners which can be adapted, by way of adjustment, to the changing inner diameter of the chimney. The runners which, in the manner of a sled runner, are slightly curved in their central region and may also be bent upward at their ends (for guidance upwards as well as downward) ensure low-friction sliding without the danger, even if there are irregularities in the inner wall of the chimney, of getting caught too frequently. The same pressure fluid that is also used as the operating means for the fluid motor may be employed, if required, for the adjustment but it is advisably supplied by way of a separate control line and is controlled from outside the chimney, e.g. from the upper end of the chimney. Advisably, but not necessarily, the control line and the pressure fluid line are combined into one conduit member, for example by tying them together by means of fastening bands, particularly adhesive strips, which are distributed over their length.

DE-A 1,229,230 discloses the distribution of guide rollers (reference numeral 8) which serve as sensor or slide components in the form of two axially successive rings about the circumference of a rotary, tool. In another guide device according invention, such a pointwise support of the fluid motor itself is effected in that it is given a resilient structure so as to provide for automatic adaptation to changing inner diameters of the chimney. The cutting wheels according to a further feature of the invention offer the advantage of being able to penetrate, in old chimneys already covered in soot, down to the actual interior wall of the flue gas carrying section provided in the original structure and thus to stabilize the desired guidance; otherwise rolls or rollers may be employed.

In principle, very high numbers of revolution can be realized with fluid motors, particularly pneumatic motors, all the way to the transition region from milling to grinding (20,000 rpm and more). Without step-down gearing, however, only relatively brittle materials can be milled. However, as an ancillary function, the fluid motor according to the invention may also be utilized for additional work on an already pre-milled chimney, after exchanging the milling cutter for a grinding tool.

For more difficult materials, however, it is advisable for the action of the milling cutter on the masonry work to be milled out to be augmented, be it by a step-down gear or, be it by adding a hammering action in the angular direction. By means of the step-down gear, the high rpm of the rotor of the fluid motor is converted to a high torque at the milling cutter. In both cases, the step-down gear and the striking mechanism are provided as a short axial extension without additionally increased outer diameter, if necessary as a removable insert. Step-down gears may here be configured to have successive stages particularly in the axial direction, with planetary gears individually and in series connection having been found to be particularly suitable.

The fluid motor provided in the apparatus according to the invention, particularly in the form of a pneumatic motor, is suitable, in view of its structural type, to be carried along with the milling cutter not only in an already milled-out chimney region, as this is generally the case when milling from the top to the bottom, but also to be carried together with the milling cutter initially downward through a chimney region yet to be milled out to then perform the milling toward the top. It is known to connect the milling cutters of apparatus for milling out a chimney to be lined with a drive motor disposed above the milling cutter by way of a flexible shaft and to enlarge the chimney cross section by moving the milling cutter up and down (preamble of claim 1 of DE-A 1,229,230). Such a milling process may take place in one stage from the bottom to the top (see, for example, WO 86/00391) or in several stages with the milling occurring layer by layer, possibly with subsequent smoothing. The apparatus according to the invention is suitable for all possible modes of operation, upward and downward, in one stage and in multiple stages.

A first type of milling head according to the invention has a relatively large width between its blades from the outside to the inside. It is used for normal milling of the chimney, while embodiments having blades which become thinner from the outside toward the inside are particularly suitable for finishing work or smoothing.

A second mentioned type of a milling cutter according to the invention is suitable for rough excavation work. It differs from normal chain grinding heads in that the chain links are equipped with milling elements.

In the first as well as in the second type of milling head, the layer to be milled can be attacked conically in such a way that with successive milling in the axial direction, initially radially further inwardly disposed effective regions of the cutting tool come into engagement and then radially farther outwardly located effective regions.

A third type of a milling cutter according to the invention is equipped with milling heads whose circumference is occupied by projecting milling pins. Such a structure has been found to be particularly suitable for the grinding milling of fire-clay pipes, with similar effects also probably occurring in glass pipes, other ceramic pipes or concrete pipes, and likewise in ceramic tiles and other comparable materials. It has been found that it is possible to mill such pipes very quickly while disintegrating their structures. Moreover, such milling heads can also be used in other, more conventional cases, such as for molded stones, some natural rock and particularly also in initial restorative layers formed of intruded concrete. In view of the pivotability of the arms carrying the milling heads, there is again a conical adaptation of the direction of feed in the milling process.

Insofar as a cutting tool has been mentioned heretofore, this should also include an embodiment composed of several partial tools which may be configured as described. Thus, according to a further feature of the invention the tool components are arranged relative to one another in such a manner that they require no or only a slight support of their external torque by way of a guide in fixed engagement with the inner wall of the chimney. Other possibilities to omit such torque support in part or, in particular, entirely, will be discussed below.

According to a further feature of the invention, all milling cutters in question and particularly the above mentioned preferred three structures may be configured in such a manner that the same milling cutter can simply be retrofitted from one orientation for milling from the top to the bottom to milling from the bottom to the top, or conversely, by changing its attachment orientation.

A changeable milling cutter, however, requires retrofitting after every operating stroke. However, particularly for material removing enlargement in several stages during the downward stroke as well as during the upward stroke of the milling cutter, it is recommended, according to another feature of the invention, to give the milling cutter a double-action configuration so that the tool is configured to mill upwards as well as downward.

With respect to the sequence of the work, it is most favorable to give the milling cutter a double-action geometry. This may be realized easily in the above-discussed, preferred first and second embodiments of the milling cutter (with blades or chains). If the working edge of the milling cutter lies on an effective cone, this cone is advisably arranged double in a tandem configuration so that the large areas of the effective cone face one another.

For some applications, however, milling cutters are preferred in which such an arrangement is not possible. This applies, in particular, also to the above-mentioned preferred third type (pivotal milling heads equipped with milling pins). In the case of this preferred third type, and possibly also for other known milling cutters, a configuration according to a further feature of the invention is then recommended. According to such a feature, the effectiveness of the operating direction of the milling cutter in question at the end of a working stroke in one direction can be changed without having to disassemble and newly reassemble the milling cutter. One such change may be effected, for example, again by means of the operating fluid, particularly the pneumatic fluid, in that a separate redirect line leads to the operator's work station outside of the chimney. This redirect line can also be combined into a unit with the fluid hose. In the case of the above-mentioned third type, it is then merely necessary to release the pivot limitation of the pivot arms, to place the pivot arms in the other axial direction and to limit their pivot angles again in that orientation.

For similar considerations, it is recommended to also configure a possibly provided positive guidance for the fluid motor as a double-action device, that is, which guides upwards as well as downwardly.

The milling cutters equipped with a striking mechanism according to the invention have already been discussed above in connection with a reinforcement of the milling effect. Additionally, they offer the advantage that most of the torque support and particularly all of it may be omitted, since the respective cutting element springs back like a spring in the manner of a hammer striking an anvil and thus provides for a compensation of the countertorque.

The apparatus according to the invention is well adapted for use in chimneys of greatly varying height, from single-family homes to multi-story apartment buildings. single-family homes generally have chimney heights, measured from the bottom of the basement to the top chimney opening, at most within a range from 8 to 12 meters in height. Three-story apartment houses begin with a height, from the bottom of the basement, of 16 to 17 m. Eight-story apartment houses, for example, have a corresponding chimney height of about 48 to 50 m. All such heights of three-story apartment houses and up can be easily milled with the device according to the invention in one run and with unchanging torque, with there not existing a height limitation, in principle, due to the very low weight and great flexibility. If it should be desired once to work from the side of a chimney, this is also easily possible because of the simple structural configuration of the apparatus according to the invention. In particular, there is practically no limit with respect to the length of the pressure fluid hose so that milling far from the location of a hydraulic oil pump or a compressor is possible. Therefore, the latter can generally always remain set up next to the building whose chimney is to be restored.

BRIEF DESCRIPTION OF THE DRAWING

The invention will now be described in even greater detail with reference to schematic drawings of several embodiments. It is shown in.

DESCRIPTION OF THE PREFERRED EMBODIMENTS

Figure 1:
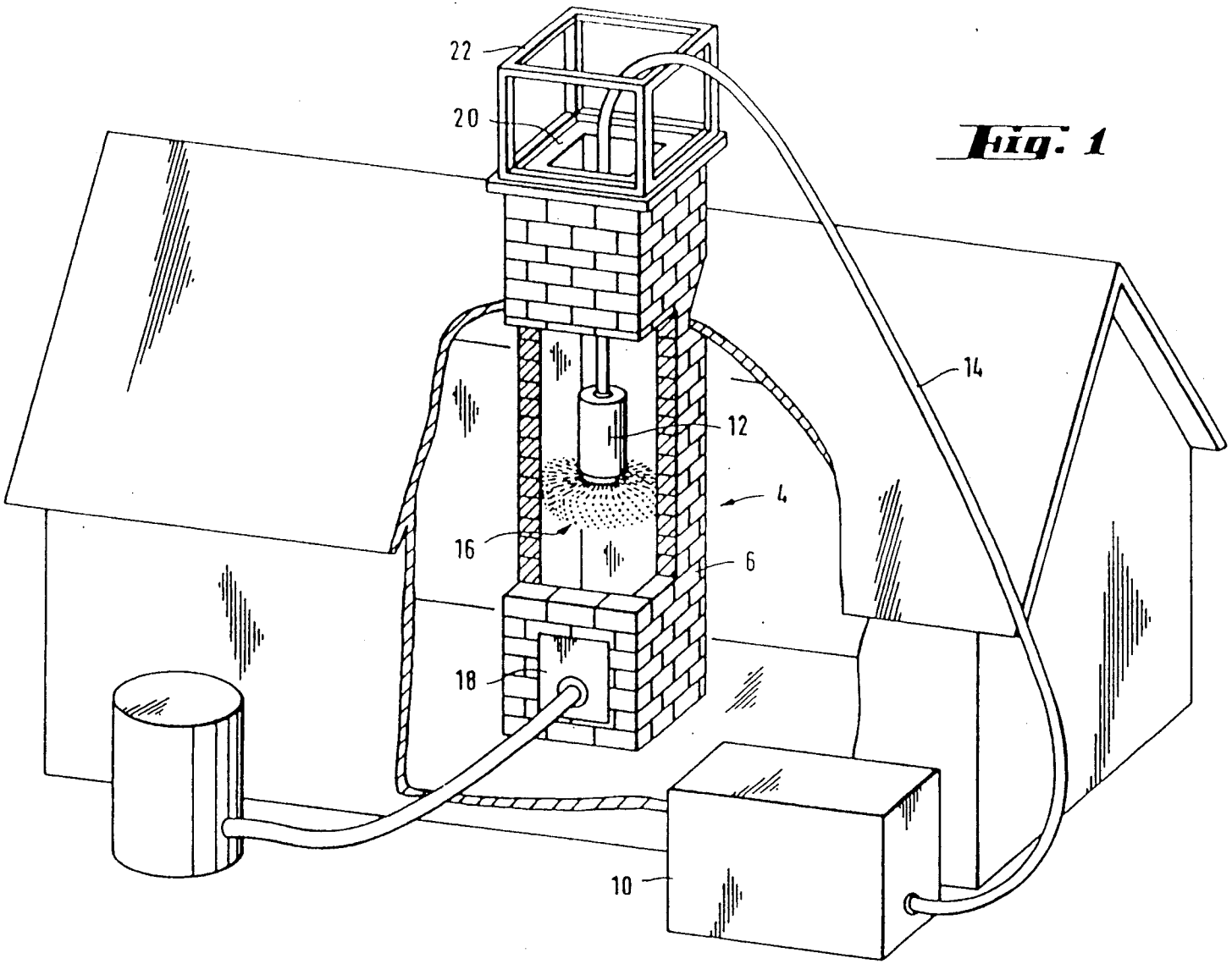
FIG. 1, a perspective total illustration as an overview illustration.

FIG. 1 shows, in a schematic representation, a "cut-open" house and a chimney likewise shown in section.

A compressor 10 set on the floor is connected by means of a fluid hose 14 which supplies compressed air to a fluid motor 12 in the form of a pneumatic motor that is lowered into the chimney. The fluid motor is equipped with a milling cutter 16, here formed by chains; however, it may also be formed, for example, by a suitably configured milling crown.

Charging of fluid motor 12 with compressed air causes milling cutter 16 to rotate to thus mill the chimney flue, also removing soot deposits in the inner flue shell of the chimney and removing projecting wall portions to return the chimney to its rated diameter. In this example, the chimney is continuously milled out from the bottom to the top by slowly raising fluid motor 12 together with milling cutter 16. It is also possible to work from the top to the bottom, for example, with the above-mentioned milling crown.

A suction device is introduced at the lower end of the chimney to suck away the developing dust.

By means of the exhaust air from the fluid motor fed to the compressor, an over-pressure is generated in the chimney which permits simple outflow of the developing dust so that no or only very little suction power is required.

Instead of compressor 10 and the pneumatic motor, the system may be operated hydraulically with oil in which case a hydraulic oil pump 10 can be employed and a hydraulic motor takes the place of fluid motor 12.

The apparatus according to the invention will now be described in greater detail.

A chimney 4, here a house chimney, is erected on a chimney foundation 2, the chimney including a circumferential outer chimney structure 6 surrounding an inner shell provided as a flue gas conducting inner pipe train 8.

Without limiting its general applicability, the supporting chimney structure 6 is here shown as a masonry structure of synthetic or natural stones and the inner pipe train 8 as a continuous layer made, for example, of centrifuged cement. As an alternative, any other single or multi-shell chimney structure is applicable, with or without additional intermediate shells such as, for example, thermal insulation layers or vapor diffusion barrier layers. In particular, the inner pipe train may also be composed of fire-clay or steel pipes and may comprise, in the usual manner, axially juxtaposed partial elements which are usually sealed by grout or other sealing materials.

In the region of the lower end of chimney 4, above chimney foundation 2, there is disposed an opening accommodating a chimney damper 18 through which soot is usually removed. Chimney 2 ends at the top in a frontal plateau 20 on which a non-illustrated chimney cope (in modern chimneys possibly by way of a non-illustrated terminating plate may be placed onto the building. The milling out of chimney 4 is advisably effected with the chimney cope removed and, if applicable, the terminating plate also removed. A supporting frame or supporting scaffolding 22 is mounted on plateau 20 in such a manner that it cannot be moved laterally, e.g. by clamping it to the upper outer chimney edge. Aligned with the axis of chimney 4 possibly adjustable laterally in both horizontal degrees of freedom, supporting frame 22 is equipped with a roller 24 over which, in the arrangement according to FIG. 1, fluid hose 14 and, in the arrangement according to FIGS. 2 to 4, a traction cable 26 is guided. Fluid motor 12 is here suspended from this traction cable 26 which, in FIG. 1, is fluid hose 14 itself. If this fluid hose 14 itself is to take over the pulling function, it must be given the appropriate tensile strength, for example in the form of a high tensile strength hose reinforcement or hose covering.

Traction cable 26, for example a steel cable, is actuated from a cable winch 28 which is replaced, in the case where the fluid motor is suspended from fluid hose 14 as shown in FIG. 1, by a roller 24 which is configured as a hose wind-up reel likewise operated in the region of supporting frame 22, During operation, the shaft of cable winch 28 or a hose unwinding reel is rigidly fastened to the supporting frame so that the winding forces are absorbed by way of the supporting frame at the upper end of chimney 4. Cable winch 28 is advisably adjustable in height.

Fluid hose 14 is here guided separately from traction cable 26 out of the upper end of chimney 4 and is connected with a compressor (see compressor 10 in FIG. 1) outside of the chimney. The compressor is driven by an internal-combustion engine, advisably a Diesel engine. The compressor as well as the internal-combustion engine are mounted on a chassis 30 equipped with a fixing brake 32 and are surrounded by a sound absorbing hood 34. Chassis 30 may be set up on any flat ground surface 36 next to the building in which chimney 4 is erected and can be braked to be fixed relative to this ground surface.

On the same ground surface 36, likewise on chassis 38 and 40, a preliminary separator 42 is provided for the coarse milled material as well as a primary separator 44 for the milling dust communicating with the preliminary separator and arranged behind it in the direction of extraction, the latter likewise being driven by a motor. For this purpose, for example, two electric motors 46 may be provided or alternatively two pneumatic motors, which then advisably are also fed by the compressor disposed underneath hood 34. The two electric motors 46, when fed by the locally customary mains voltage, permit a corresponding multiplication of the available drive power and can thus eliminate the need for a heavy current connection. If necessary, more than two such motors 46 may also be provided.

The primary separator is configured, for example, as an industrial vacuum cleaner and is connected, by way of the illustrated suction lines extending through the opening in chimney damper 18, to the base region of chimney 4 above chimney foundation 2.

The milling cutter 16 shown in FIG. 2 will now be described in greater detail with reference to FIG. 14. The milling cutter 16 employed in FIGS. 3 and 4 will be described in greater detail with reference to FIG. 15.

Figure 2:
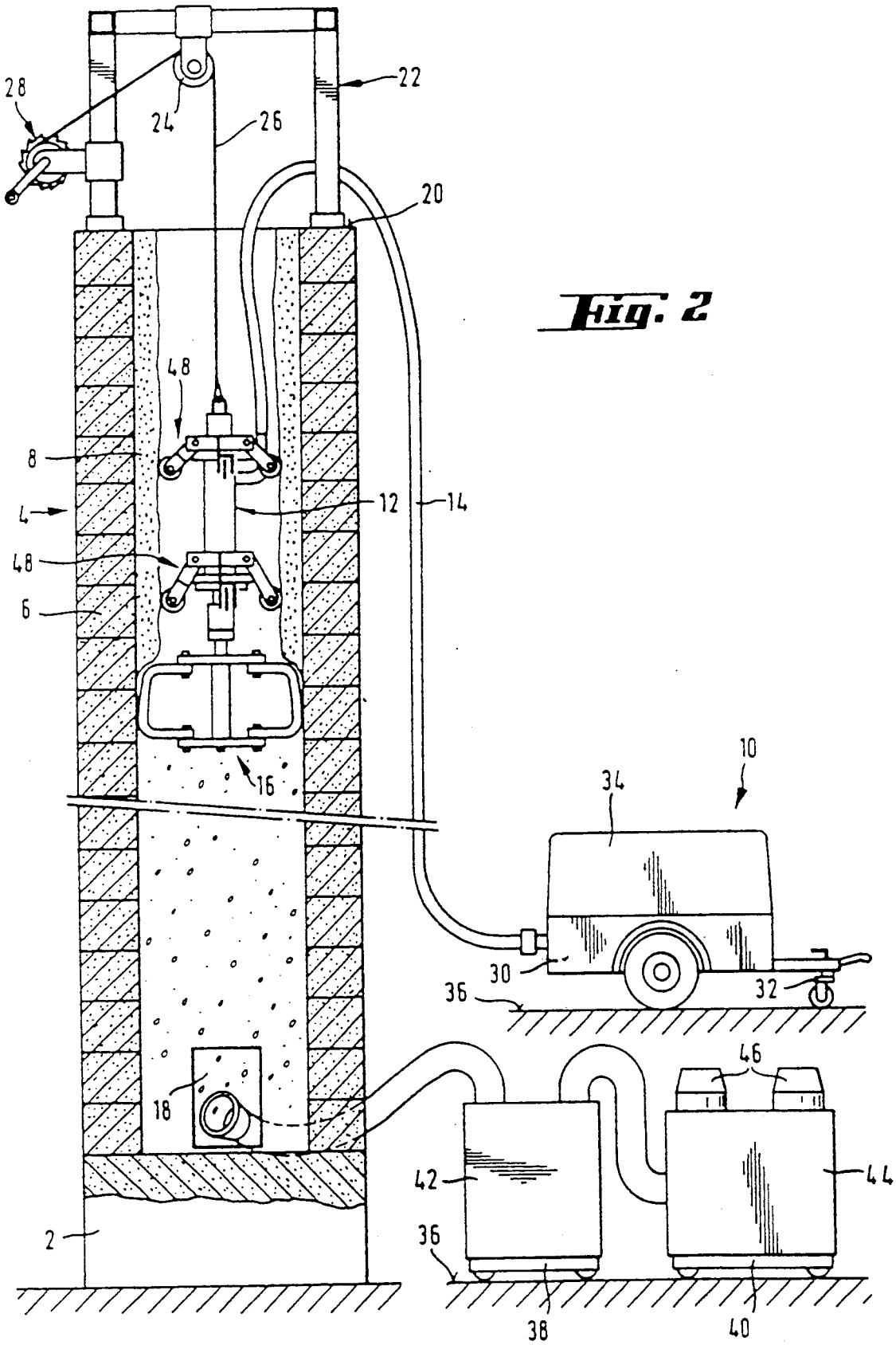
FIG. 2, a longitudinal view for demonstration including an upwardly milling blade-type milling cutter.
Figure 3:
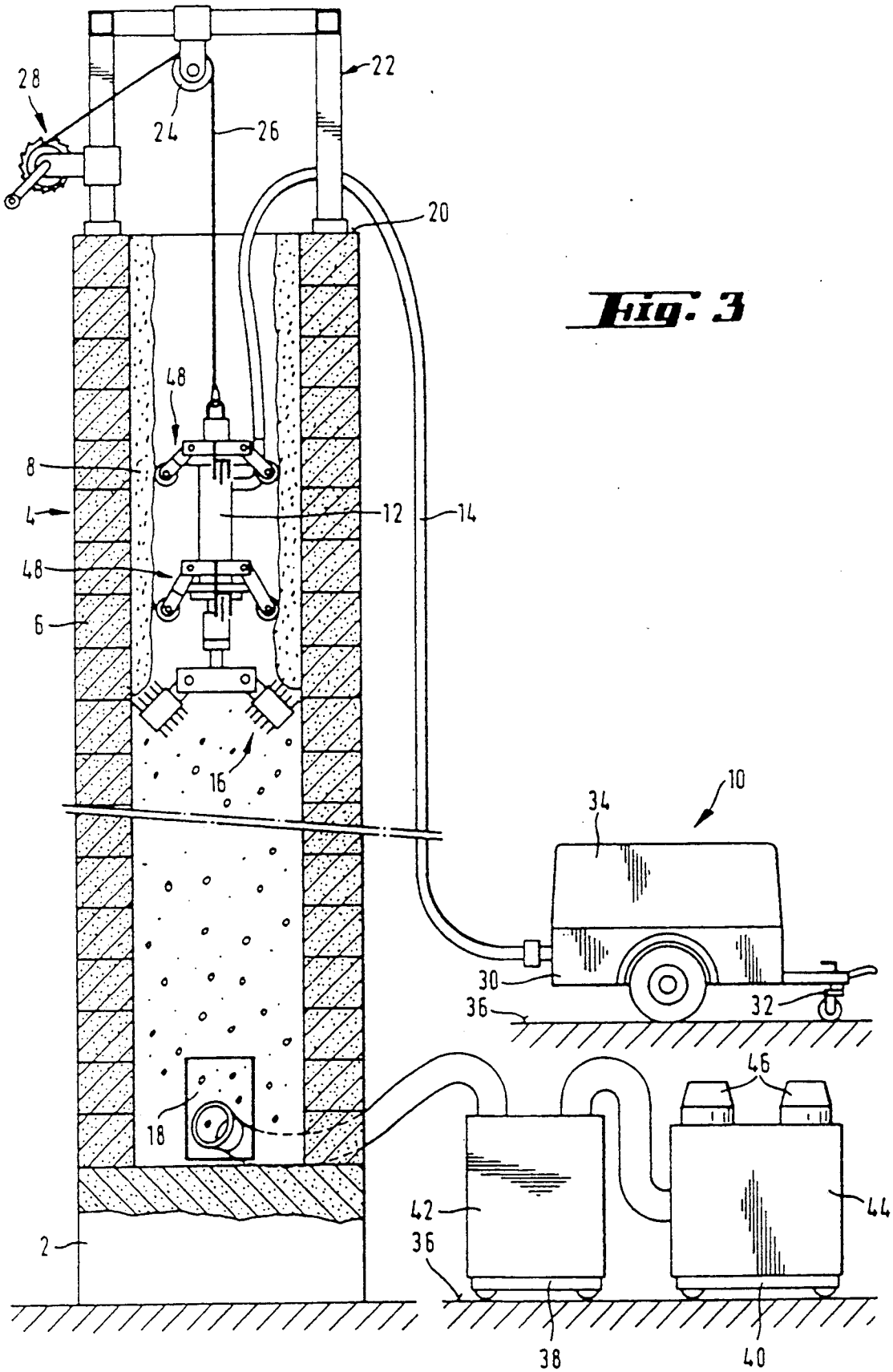
FIG. 3, a corresponding cross-sectional view for demonstration including an upwardly cutting milling-pin milling cutter.
Figure 4:
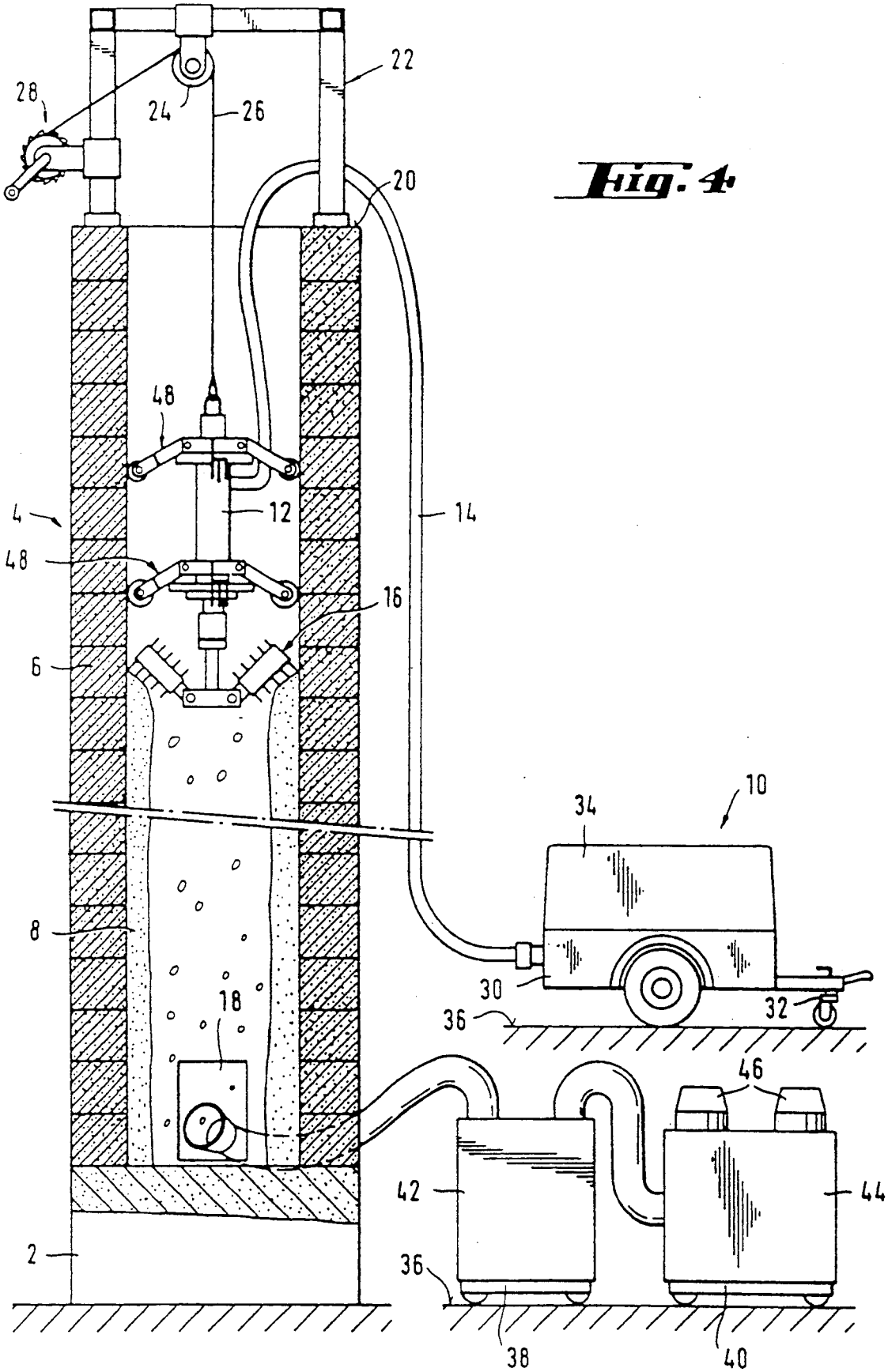
FIG. 4, the same longitudinal sectional view for demonstration including a downwardly operating milling-pin milling cutter.

In FIGS. 2 to 4, fluid motor 12 is additionally provided with a guide 48 as it will be described in greater detail with reference to FIGS. 9 and 10*a* to 10*d*.

Fluid motor 12 itself is configured as described below in connection with FIG. 5, possibly including FIG. 6, which requires guidance. If a fluid motor is employed which does not necessitate external positive guidance, for example the fluid motor shown in FIG. 7, the guide 48 is omitted with otherwise the basic structure remaining as shown in FIGS. 2 to 4.

According to FIGS. 2 and 3, the milling out of inner pipe train 8 which carries the flue gas is effected in one sweep from the bottom to the top, in the arrangement according to FIG. 4 also in one sweep from the top to the bottom. Alternatively, the inner layer 8 here interpreted as inner pipe train could also include only the inner zone covered in the milling process, with radially successive zones being removed one after the other from the inside out in alternating milling operation downward, upward, downward, etc. Subsequent finish working stages, such as smoothing processes, can also be performed with an exchange of milling cutter 16 by means of the same fluid motor 12.

Since, in the embodiments of FIGS. 1 to 4, fluid motor 12 is always disposed above cutting tool 16, it inevitably results that guide 48 according to FIGS. 2 and 3 is guided along the not yet milled out inner zone, i.e. the flue gas carrying inner pipe train, during work in one sweep and along the already milled out inner wall face of the chimney during milling from top to bottom as shown in FIG. 4.

With a suitable connection of fluid hose 14, the milling cutter 16 may, if necessary, also be arranged at the top (not shown) and fluid motor 12 at the bottom; however, this involves the difficulty of having to conduct the fluid motor, when it is introduced from the top, through the body of the milling cutter or, in the alternative, to introduce fluid hose 14 initially from the bottom through the opening in chimney damper 18 or through some other opening.

Figure 5:
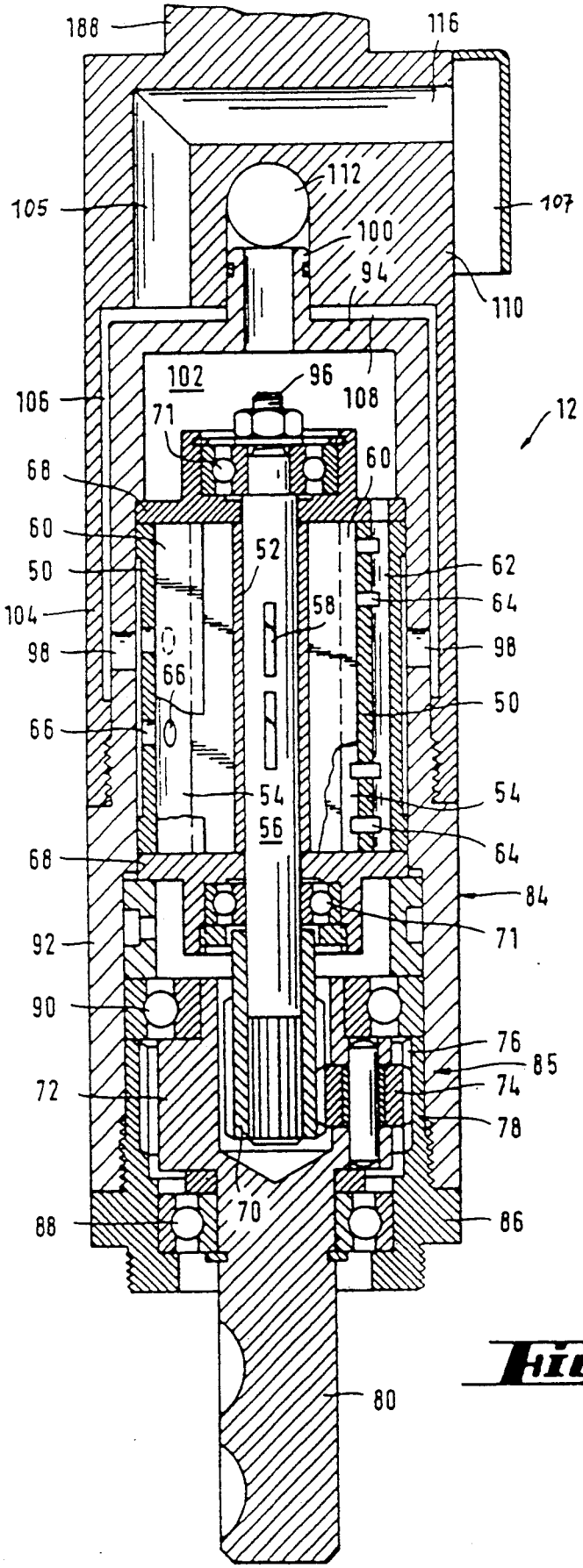
FIG. 5, an axial longitudinal sectional view of a pneumatic motor as a fluid motor having a single-stage planetary drive.

The pneumatic motor 12 shown in FIG. 5 includes a cylinder 50, with the rotor 52 of pneumatic motor 12 extending along the axis of this cylinder. Cylinder 50 is delimited on the exterior and interior by a cylinder surface, with, however, the inner cylinder surface being arranged eccentric to the outer cylinder surface. Thus, cylinder 50 has a correspondingly changing wall thickness. Rotor 52 has a cylindrical outer surface which together with the eccentric inner surface of cylinder 50 defines a compression chamber 54 (shown in cross hatching). Rotor 52 itself is fastened to a rotor shaft 56.

On the circumference of rotor 52, which is formed of a solid cylinder shell, slots 58 are distributed tangentially to rotor shaft 56 so as to extend over the entire axial length of rotor 52 and end at a radial distance from rotor shaft 56. In practical embodiments, for example, between four and six such slots are provided. Rotor blades are loosely placed into the slots. While fluid motor 12 may otherwise be made of steel, rotor blades 60 may be composed of a suitable plastic, e.g. of Phenoplast or melanin resins as they are sold, for example, under the registered trade name "Pertinax". Rotor blades 60 are linear at their longitudinal edges coacting with the cylindrical inner surface of cylinder 50 and, at their longitudinal edges engaging in the slots, they are flattened to complement a corresponding basic configuration of the slots so as to be axially guided in the slots in their radially deepest engagement position. During rotation of the rotor shaft, the rotor blades are pressed outwardly by centrifugal force to contact the inner wall surface of cylinder 50. In this way, they divide compression chamber 54 into traveling chambers which are distributed over the circumference of the rotor shaft, the sufficiently tight contact of the slots with the rotor blades substantially preventing any short-circuit air between the chambers.

In the thick wall region of cylinder 50, two continuous, axially parallel bores 62 extend next to one another in the circumferential direction. Through these bores, compressor 10 supplies compressed air through a compressed air hose 14 and four slots 64 to compression chamber 54. Slots 64 extend in the circumferential direction of cylinder 50 and are arranged in pairs in the vicinity of the two ends of the cylinder.

Radially continuous discharge holes 66 ar distributed in the sickle-shaped area of reduced cylinder wall thickness as it decreases in the direction of rotation of rotor 52. Advisably, in each axial region between slots 64, several of these holes, for example five, are distributed over the circumference of cylinder 50 in several rows, for example in two rows. Cylinder 50 is tightly closed by a cover 68 at each of its two end faces. On its side facing away from compression chamber 54, each cover 68 is provided with a ball bearing 71 for rotor shaft 56, the latter passing in a sealed manner through axial openings in both covers 68 and is otherwise secured against axial displacement.

On its side facing milling cutter 16, rotor shaft 56 is extended beyond ball bearing 71 to serve as input shaft of a single-stage step-down gear, here a planetary gear. So far, the planetary gear corresponds to the lower half of the exposition drawing of FIG. 6 which shows, in its upper half, further elements for a two-stage configuration of the step-down gear, here an axially series connected two-stage planetary gear.

On the driven end of the rotor shaft outside of cylinder 50, there is consequently seated a pinion 70. This pinion engages in inner teeth of a planetary cage 72. The planetary gears 74 mounted in this cage mesh with a sun gear ring 76. The latter is rigidly disposed at the interior face of a cup-shaped widened portion 78 of a output shaft 80 to which the shaft of milling cutter 16 is coupled so as to be secure against rotation.

Figure 6:
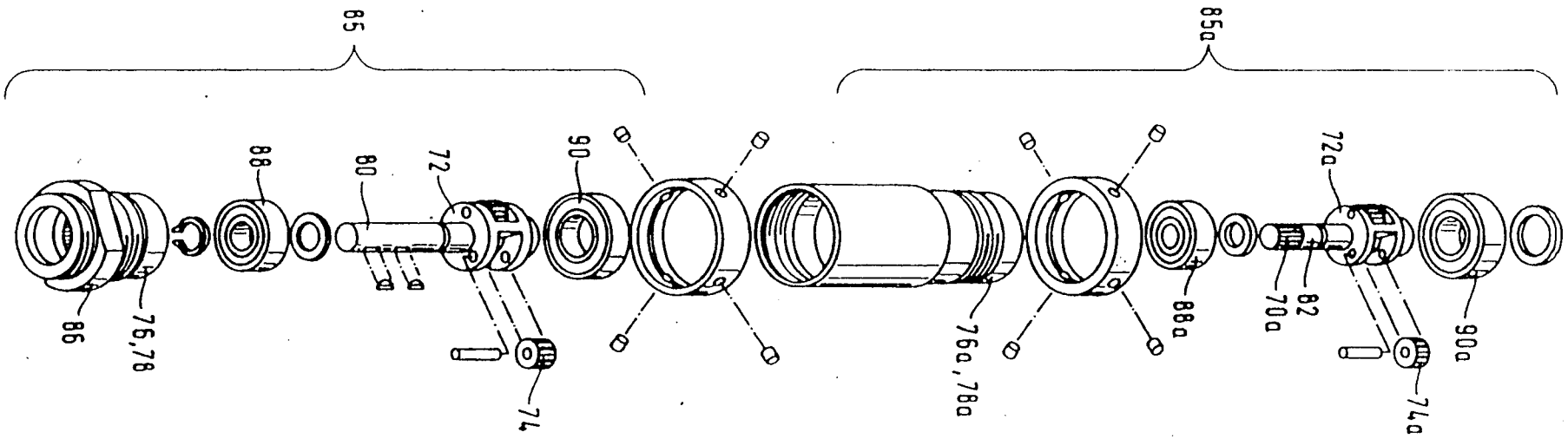
FIG. 6, an expositional illustration of a two-stage planetary drive that can be used as an alternative.

In the variation shown in FIG. 6, a second planetary wheel stage axially follows between output shaft 80 and the described first stage of the planetary gear, with the components of this second planetary wheel stage being indicated in FIG. 6 by the additional letter a on otherwise unchanged functional components.

The only difference is that the first stage of the planetary gear drive is not connected directly to output shaft 80 but that, in the otherwise identical configuration as in the end of the drive shaft facing the pneumatic motor, an axially flush intermediate shaft 82 is employed on which is seated a pinion 70*a* which in its force introducing function corresponds to pinion 70 at the input end of the first gear stage.

The entire unit composed of cylinder 50 including covers 68, rotor shaft 56 mounted therein and the planetary gear marked as a whole with 85 (second stage 85*a*) is surrounded on its side facing the suspension and all around by a two-part solid armored housing 84, with a solid lower terminating plate 86 which, in its interior, supports a first ball bearing 88 for output shaft 80 and is connected tightly with armored housing 84, closing off the housing on the side facing milling cutter 16.

Moreover, output shaft 80 is mounted in a second ball bearing 90 which is fastened to the interior of a first member 92 of the armored housing. This first member 92 is arranged in the manner of a hood and includes, starting with terminating plate 86, all above-mentioned components of driven housing(s) and pneumatic motor, with hood bottom 94 being disposed opposite the free end 96 of rotor shaft 56 disposed opposite output shaft 80.

At each of its two frontal ends, cylinder 50 is provided with a somewhat projecting annular flange and these annular flanges are fitted tightly into the housing of first member 92 of armored housing 84. Thus a certain annular gap is created between the exterior face of cylinder 50, the two annular flanges and the interior face of the above-mentioned first component 92. Exhaust air from compression chamber 54 exiting from discharge holes 66 is able to be freely distributed through this annular gap. This exhaust air is able to further escape radially toward the outside through a ring of discharge holes distributed circumferentially over the walls of first component 92.

The compressed air is fed to the pneumatic motor through an axially upwardly extending intake connection piece 100 which is integrated in hood bottom 94. From there, the compressed air travels through the free space 102 formed below hood bottom 94 within first component 92 to bores 62 and from there in the described manner finally to compression chamber 54.

The second component 104 of armored housing 84 is screwed onto the first component 92 of armored housing 84 o the side of the suspension for the fluid motor so as to enclose the latter. A will be described below in connection with FIG. 9, the entire unit composed of fluid motor 12 and milling cutter 16 is suspended from this second component 104.

The second component 104 encloses the first component 92 of armored housing 84 to below discharge holes 98 and is screwed into a recess in the first component in such a manner that both components 92 and 104 of armored housing 84 have a common small-diameter cylindrical exterior face.

Additionally, an annular gap 106 is formed between the two components 92 and 104 of armored housing 84 in the region where the two components overlap, with the annular gap being disposed opposite discharge holes 98 and being sealed in the region of the groove disposed at the bottom between both components of the armored housing.

Annular gap 106 is extended radially inwardly relative to the outer end face of hood bottom 94 by means of an annular gap 108 between the exterior end face of hood bottom 94 and an axially farther upwardly disposed solid extension 110 of second component 104.

In this extension there is initially formed a radial bore 112 which, outside of the armored housing, leads to an inlet connection piece extending axially next to the armored housing in order to connect it with compressed air hose 14. This connecting bore 112 is sealed against the outer end of inlet connection piece 100 at hood bottom 94.

Circumventing connecting bore 112, annular gap 108 communicates with axially and radially extending bores 105 and 107 in extension member 110 of the second component 104 of armored housing 84 so as to finally release the exhaust air from the pneumatic motor through an exhaust chute 114 disposed on the side of the armored housing into the open air and thus permit it to escape, during milling, into the interior of the chimney. The exit direction of this exhaust chute is here selected to be axially parallel in the direction toward milling cutter 16. The exhaust air escaping only over a partial region of the circumference of the armored housing is thus distributed as a bypass stream in such a way that it is not only possible to blow against the milling cutter but also to provide a block against the ascent of milling dust over the entire circumference of the armored housing.

Figure 7:
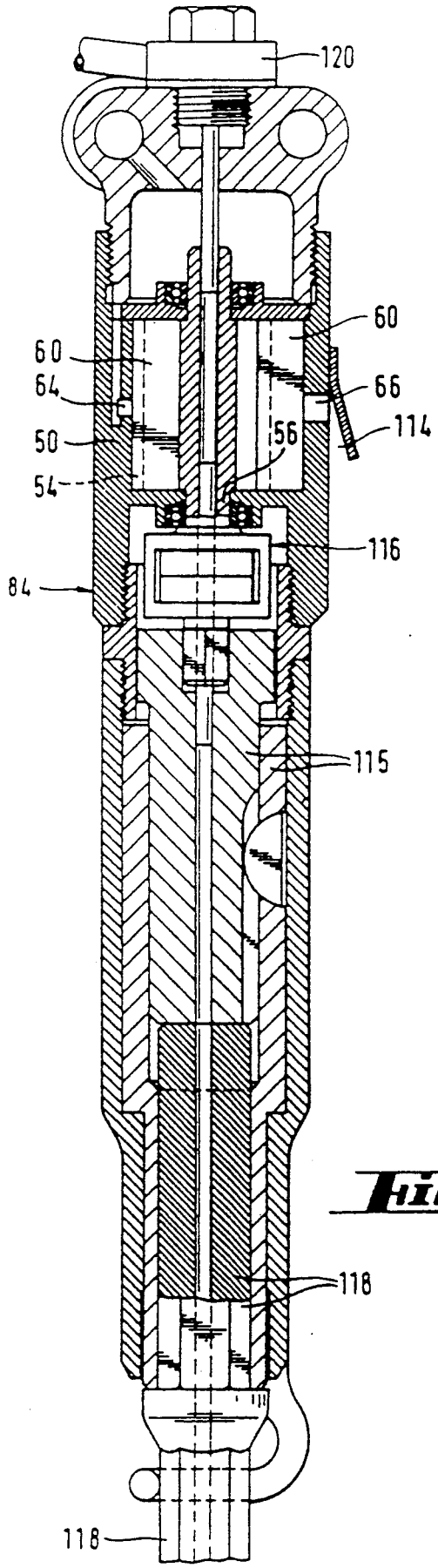
FIG. 7, a partial axially sectional view of an alternative embodiment of a pneumatic motor including a striking mechanism.

Except for the step-down gear 85 (possibly including 85*a*), the pneumatic motor according to FIG. 7 may be of principally identical configuration, regardless of deviations appearing in FIG. 7. The transmission of torque from the pneumatic motor to the milling cutter is here effected, due to the absence of step-down gears, at a transmission ratio of 1:1, i.e. directly.

Instead, the free end of rotor shaft 56 projecting from cylinder 50 on the side of milling cutter 16 is connected by way of a striking mechanism 116 with a output shaft 115 which corresponds to output shaft 80 of FIG. 5. This striking mechanism converts the continuous rotary movement of rotor shaft 56 into a rotating-striking movement with a hammer effect in the angular direction caused by the cooperation, effective per revolution of the rotor shaft, of a so-called hammer and a so-called anvil of the striking tool No axial oscillation of milling cutter 16 is here required at all, although, if necessary, an axial component could also be included.

Various structural embodiments of such a striking mechanism are known so that its details need not be described. A possible and also preferred structure will be described in greater detail below in connection with FIG. 16 for a different use. The striking mechanism according to FIG. 16 can be connected, in particular, between the fluid motor 12 on the one hand and its suspension on the other hand.

A significant feature of the incorporation of such a striking mechanism is that a countertorque generated during operation of milling cutter 16 can be compensated in a striking manner—one elastic hammer blow between hammer and anvil of the striking mechanism per revolution—by the repercussive effect in the striking mechanism.

Thus not only the step-down gears 85 and 85*a* which extends the axial structural length become unnecessary, the effect of the milling cutter on the material to be removed is also augmented considerably, comparable to the mode of operation of a hammer drill.

Another particularity of the pneumatic motor according to FIG. 7 is that drive shaft 115 is hollow and has a polygonal inner cross section, particularly a hexagonal one. Thus, commercially available milling cutters which generally have a hexagonal connection can simply be plugged in and make possible the transmission of very high torques. A corresponding plug-in member 118 of a milling cutter 16 is shown in FIG. 7.

In addition, the bore of hollow output shaft 115 may be utilized as a supply channel for control fluid, particularly compressed air, to the milling cutter. For this purpose, a control conduit connection 120 is brought out of the milling end of the hollow shaft, for example, in order to reverse a milling cutter designed for working upward and downward when the working direction is changed.

FIGS. 8 and 9 to 11 show two possible preferred structural types of positive guidance which can be employed with the type of pneumatic motor shown in FIG. 6 in which the torque requires support. Both types are distinguished by a relatively freely exposed viewing gap between armored housing 84 and the interior face of chimney 4.

Generally, these figures also show a connecting coupling 124, here a so-called plug-in nut for the connection of output shaft 80 of FIG. 5 with milling cutter 16. Also provided is an eye 122 at the upper end of the second component 104 of the armored housing, into which traction cable 26 can be hooked.

If the suspension is effected by way of fluid hose 14 shown in FIG. 1, it would be necessary, in a manner not shown, to axially arrange the connecting connection piece 126 which is here disposed on the side of the armored housing and which communicates with connecting bore 112 at the fluid motor analogously to eye 122 and to configure it so that it transmits traction force, i.e. to equip it with connecting means to the armor or to the high tensile strength sheathing of fluid hose 14.

Figure 8:
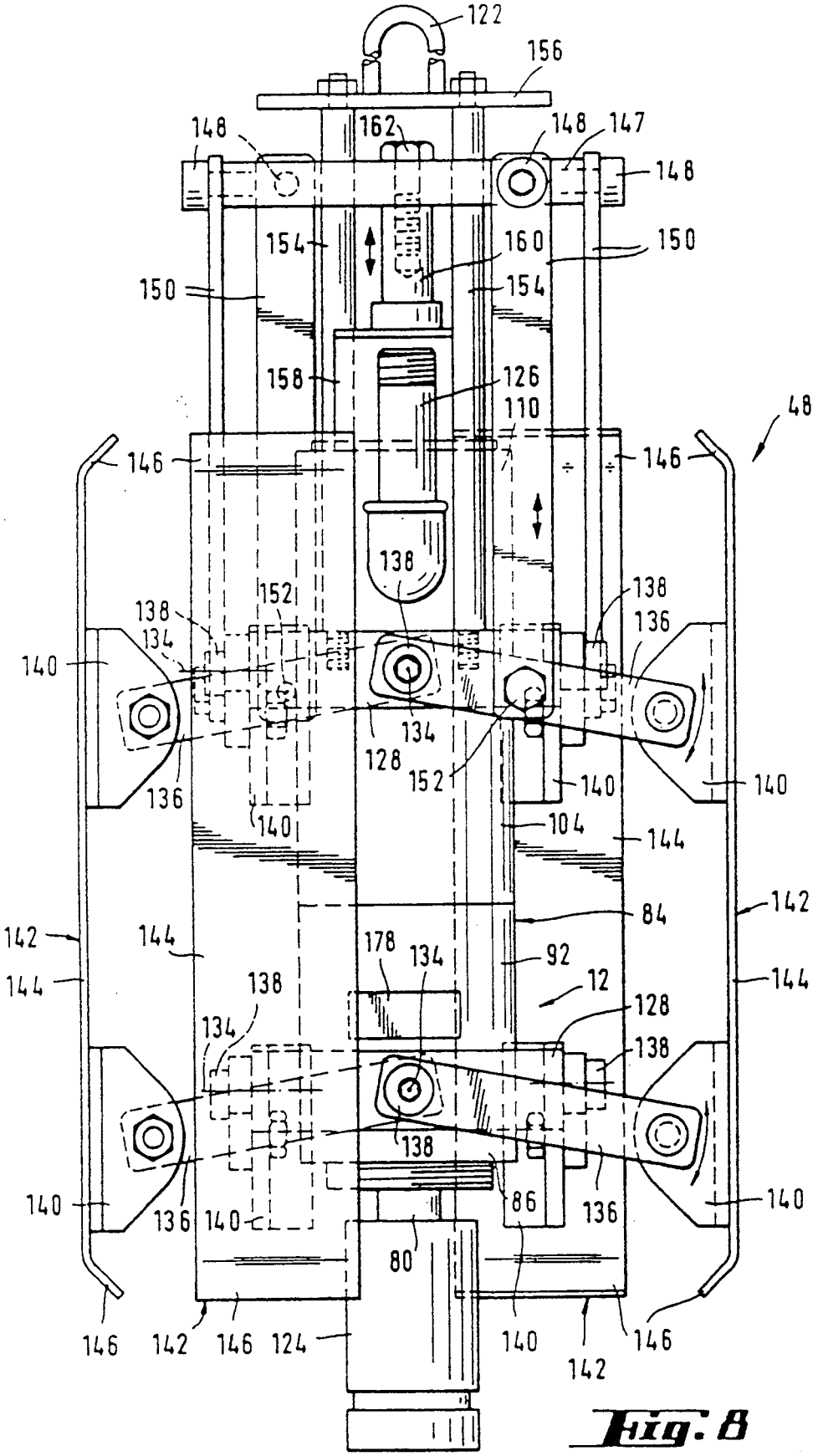
FIG. 8, a top view of the longitudinal side of a pneumatic motor of the type shown in FIG. 5 positively guided by means of runners.
Figure 9:
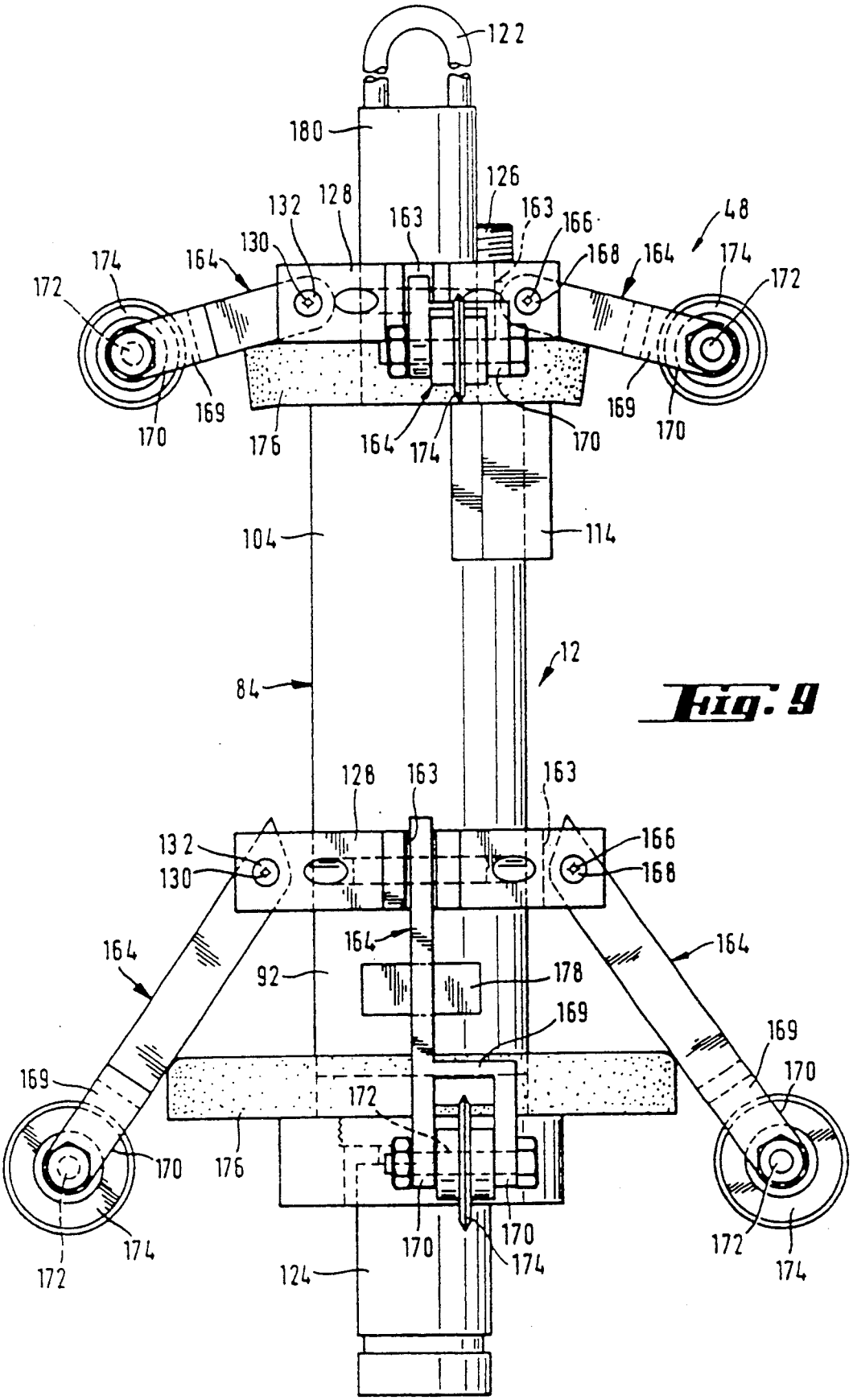
FIG. 9, a corresponding top view of the longitudinal side of the pneumatic motor of FIG. 5 with a different type of positive guidance.
Figure 10A:
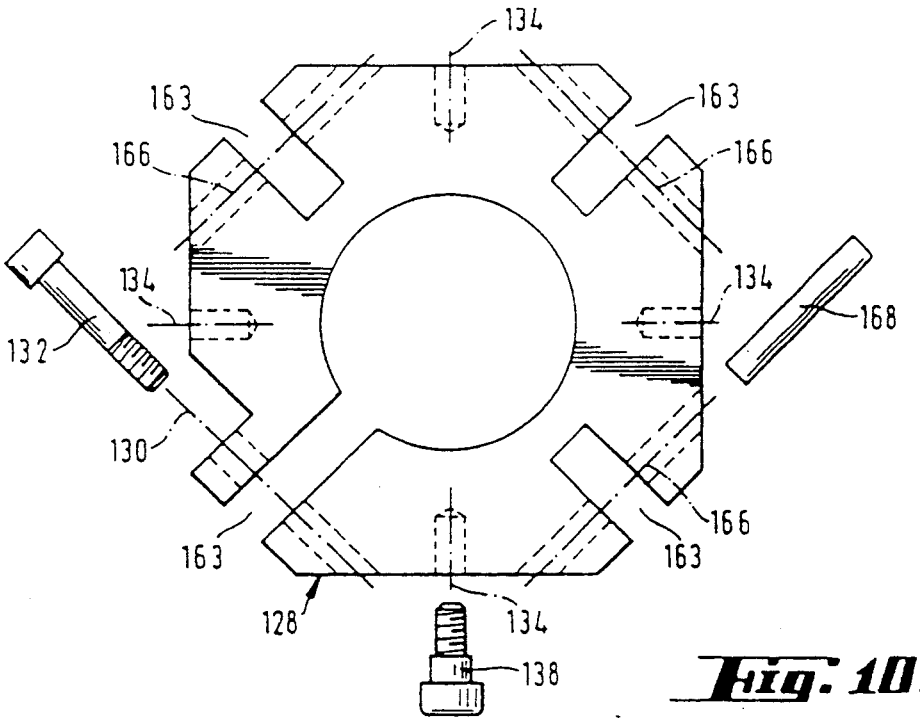
FIGS. 10*a* to 10*d*, ring-forming elements for the positive guidance of FIG. 9.
Figure 10B:
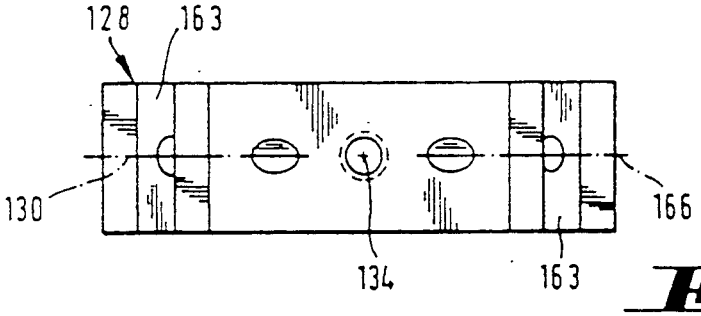
Figure 10C:
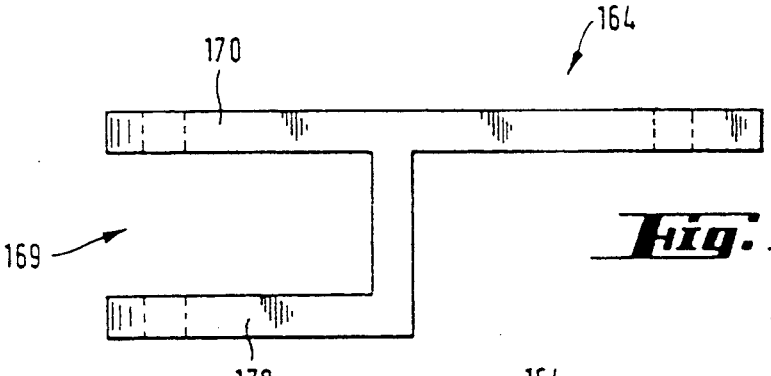
Figure 10D:
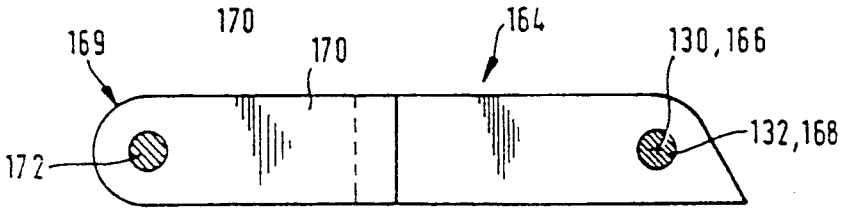

In both types of guidance shown in FIGS. 4 to 11, a holding disc 128 is disposed at an axial distance sufficient for guidance in the region of each end of armored housing 84 (see, in particular, also FIGS. 10*a* and 10*b* in which holding disc 128 is shown in a top view and in a side view). The holding disc is clamped by means of clamping screws 132 to the outer circumference of armored housing 84 along the action line 130 shown in dashed lines in FIG. 10*a*.

In the large square cross section of holding discs 128 the double dashed line 134 in FIG. 10*a* describes, in the region of the centers of the lines defining the square, a hinge axis 134 for pivot arms 136. These arms are straight levers whose one end is articulated in the region of axis 134 to a pivot pin 138 at armored housing 84 and whose other end is hinged by means of a jaw 140 to the radially inner side of a runner 142. Correspondingly, four runners 142 are distributed over the circumference of the pneumatic motor. These runners have an elongate, at least approximately linear center section 144 and inwardly curved or obliquely projecting ends 146 at the top and bottom.

In this configuration, the exterior face of armored housing 84, the runners and the two pivot arms hinging the respective runner at the top and bottom together form a parallel guide rod assembly.

The radial width of all four parallel guide rod assemblies is adjusted jointly by means of an axially displaceable actuating plate 147. For this purpose, the circumference of the actuating plate in the region of an articulation 148 is connected by way of a pull lever 150 extending outside of and alongside the armored housing with a hinge 152 disposed in the center region of the respectively upper pivot arm 136.

Actuating plate 147 is guided so as to be axially displaceable on two diagonally oppositely disposed guide rods 154. The guide rods in turn are screwed at their lower ends into the upper holding disc 128 and at their upper ends are connected with one another by a transverse yoke 156 to which eye 122 is welded.

Without any displacement force applied, actuating plate 147 lies in its lowermost position due to the weight of the rods and runners hinged to it. A pneumatically actuated servo cylinder 158 fastened to the end face of armored housing 84 and whose plunger 160 may be loosely supported at the axial center of the actuating plate serves to raise actuating plate 147. Preferred, however, for the positive control of actuating plate 147 in both axial directions, is a fastening means 162 which is provided at the point of attack of actuating plate 147.

Figure 11:
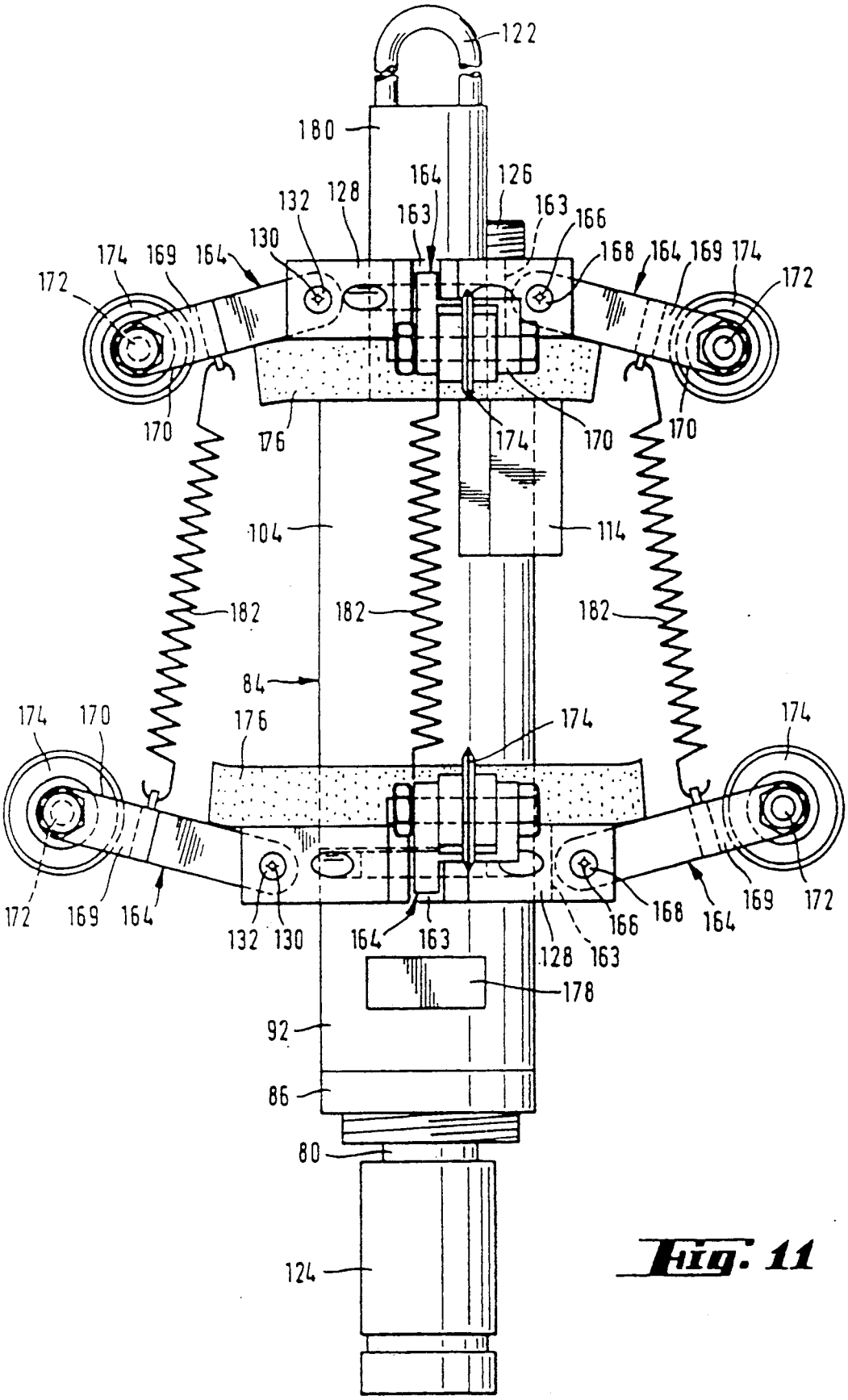
FIG. 11, a corresponding top view of the longitudinal side of the pneumatic motor with positive guidance according to FIG. 9 in double-action arrangement.

In the embodiments according to FIGS. 9 and 11, holding disc 128 is sloped at the corners of its generally square cross section and a radially extending recess 163 is provided in each corner. As in the above-described embodiment, this recess is configured as a throughgoing slot in the region of action line 130 for clamping to the circumference of the armored housing.

Within recesses 163, the one end of a linear lever 164 is articulated along the triple dashed, imaginary axis 166. The shape of lever 164 can be seen in the top view of FIG. 10*c* and in the side view of FIG. 10*d*. Hinge pin 168 of FIG. 10*d* here corresponds to action axis 166.

The free lever end is configured to have a unilateral projection forming a fork 169, with a shaft 172 accommodating a cutting wheel 174 or, in the alternative, a roll or roller being rotatably mounted on each branch 170 of fork 169.

Underneath the respective holding disc 128, there is attached in a manner secure against axial displacement an elastically yielding buffer element in the form of a rotating foam rubber ring 176, with the center region of the respective lever loosely lying on this ring in order to limit the downward pivoted lever position. If necessary, the axial position of this buffer element 176 can also be changed. By way of suitable settings, it is possible to select the same or a desired different radial deflection (e.g. in adaptation to conicities in the shape of the chimney) with different lengths of levers 164. In this sense, the upper levers 164 are drawn to a shorter length than the lower levers 164. The somewhat farther radial projection of the lower levers 164 visible in FIG. 9 is not intended to represent an adaptation to the conical shape of a chimney whose cross section is narrow at the top and wide at the bottom but is provided to compensate different stresses on the upper and lower levers since the lower levers, due to their closer proximity to the milling cutter, are stressed with more weight. Thus, it is possible to make do with buffer elements 176 of the same material. As can be seen, by the way, the lower buffer elements 176 are shown in FIG. 9 to have a greater radial projection than the upper buffer elements for the same reason.

Moreover, FIG. 9 also shows a notch 178 in the outer circumference of the armored cylinder. This notch 178 is opposed on the covered other side by a corresponding notch parallel thereto. In this way it is possible to employ one tool to screw on both components 92 and 104 of armored housing 84 with sufficient torque.

Due to the different configuration of this guide, guide rods 154 of the embodiment of FIG. 8 are here replaced by a connecting pin 180 which is fixed at the top by eye 122 and at the bottom is rigidly connected with the end face of armored housing 84.

It can be seen that connecting pin 180, a solid cylinder, has a smaller diameter than armored housing 84. This has the advantage that the upper levers 164 can be arranged to project radially for a particularly short distance. Due to the greater load on the lower levers, the problem does not occur there to such an extent. As a whole, this offers the opportunity of adaptation to particularly small inner chimney width.

In the embodiment according to FIG. 9, however, the guide guides only unilaterally, namely in the upward direction. FIG. 11 shows a simple modification with which the same guide configuration can be given a double action effect, with the same geometry and without the need for readjustment work. For this purpose, the levers arranged in a ring at the top and bottom are connected with one another by traction members 182, advisably tension springs, extending along armored housing 84. With this configuration, the lower buffer element 176 can even be omitted entirely. However, it may also be employed if the traction members 182 are made releasable.

While in both described guide configurations four guide elements are distributed equidistantly in the circumferential direction around the armored housing, it is also possible, if required, to provide a different number of such guide elements, advisably at least three of the same.

Figure 12:
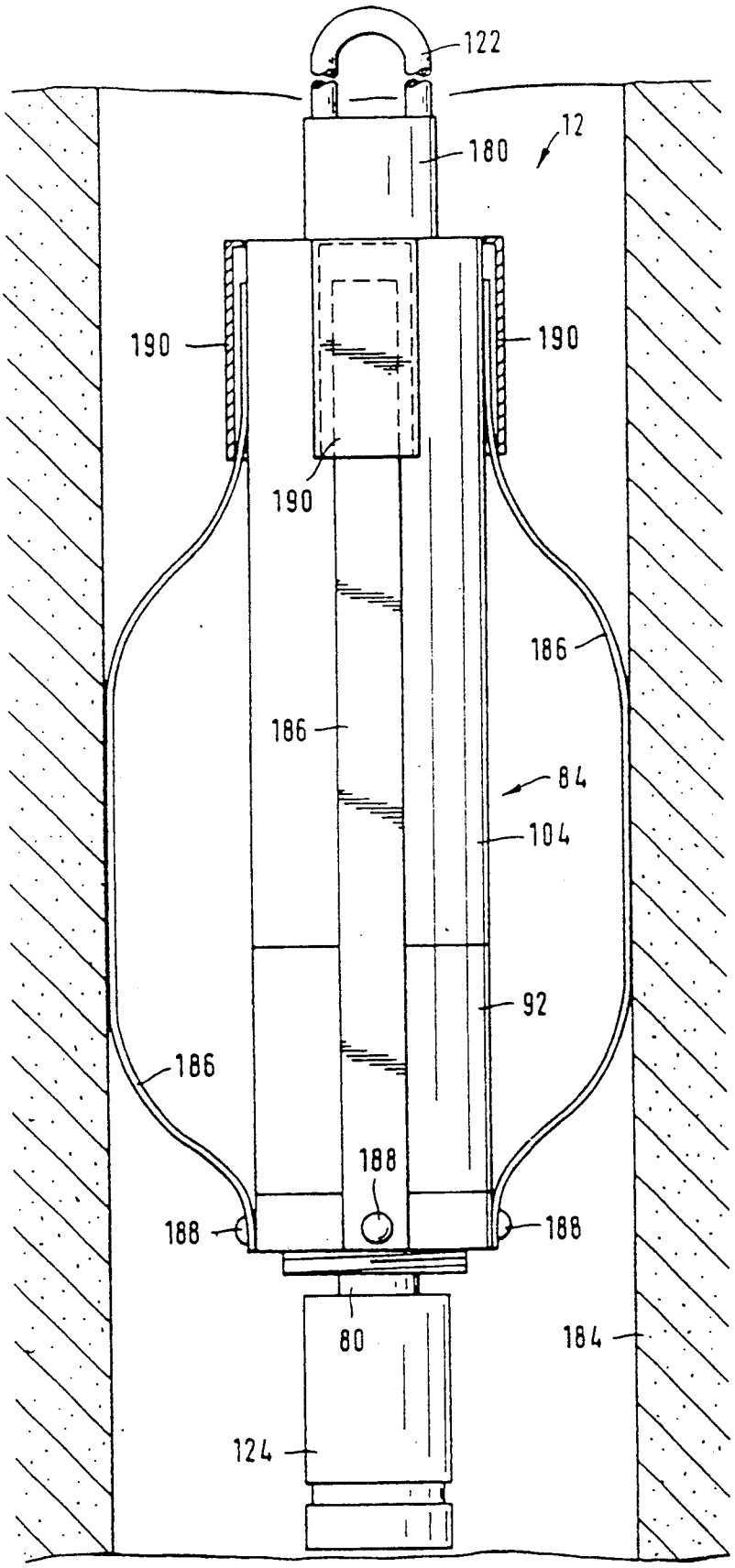
FIG. 12, an axial cross-sectional view of an inner, flue gas carrying chimney pipe equipped with a fluid motor that is centered relative to the inner wall surface of the chimney.

As already mentioned, however, there are pneumatic motors which do not require a positive guidance with runners, cutting wheels or rollers, but which, in the borderline case, may even be freely suspended. However, a centering means which does not support any torques is advisable here. A preferred embodiment of such a centering means is shown in FIG. 12.

In this figure, armored housing 84 of fluid motor 12 is shown only roughly schematically. The object is to center this armored housing at the respectively existing inner wall layer 184 of chimney 4. Depending on the direction of work, this inner wall layer may be a chimney zone that has already been milled out or a chimney zone that must still be milled out, particularly if milling of the supporting chimney structure 6 or the flue gas carrying inner pipe 8 is effected in one stage.

At least three, preferably four, bow springs 186 are distributed over the circumference of armored housing 84. The lower ends of these springs are fastened to armored housing 84 at a fastening location 188 and their upper ends engage into an axial guide 190 likewise provided at the outer circumference of armored housing 84.

It is possible to make this engagement free of any influence so that free axial mobility of the upper ends in the guide occurs with different radial compression of bow springs 186. However, the free end of the bow spring engaging in longitudinal guide 190 may also be caused to act against an adjustable stop or at least the engagement depth of the free end in longitudinal guide 190 may be selected differently, with free mobility initially existing. A servo motor may again be provided for such adjustments and may also be fed with the operating fluid as in the other remotely actuated servo cases.

In the borderline case, bow spring 186 need be in contact with the interior surface of the chimney only in a relatively small axial region. Preferred, however, is the illustrated long axial length of engagement which occupies the major portion of the length of the bow spring. Since no forces are to be transmitted here, the major advantage lies in the use of the same bow spring for chimneys 4 of quite differing widths.

Figure 13:
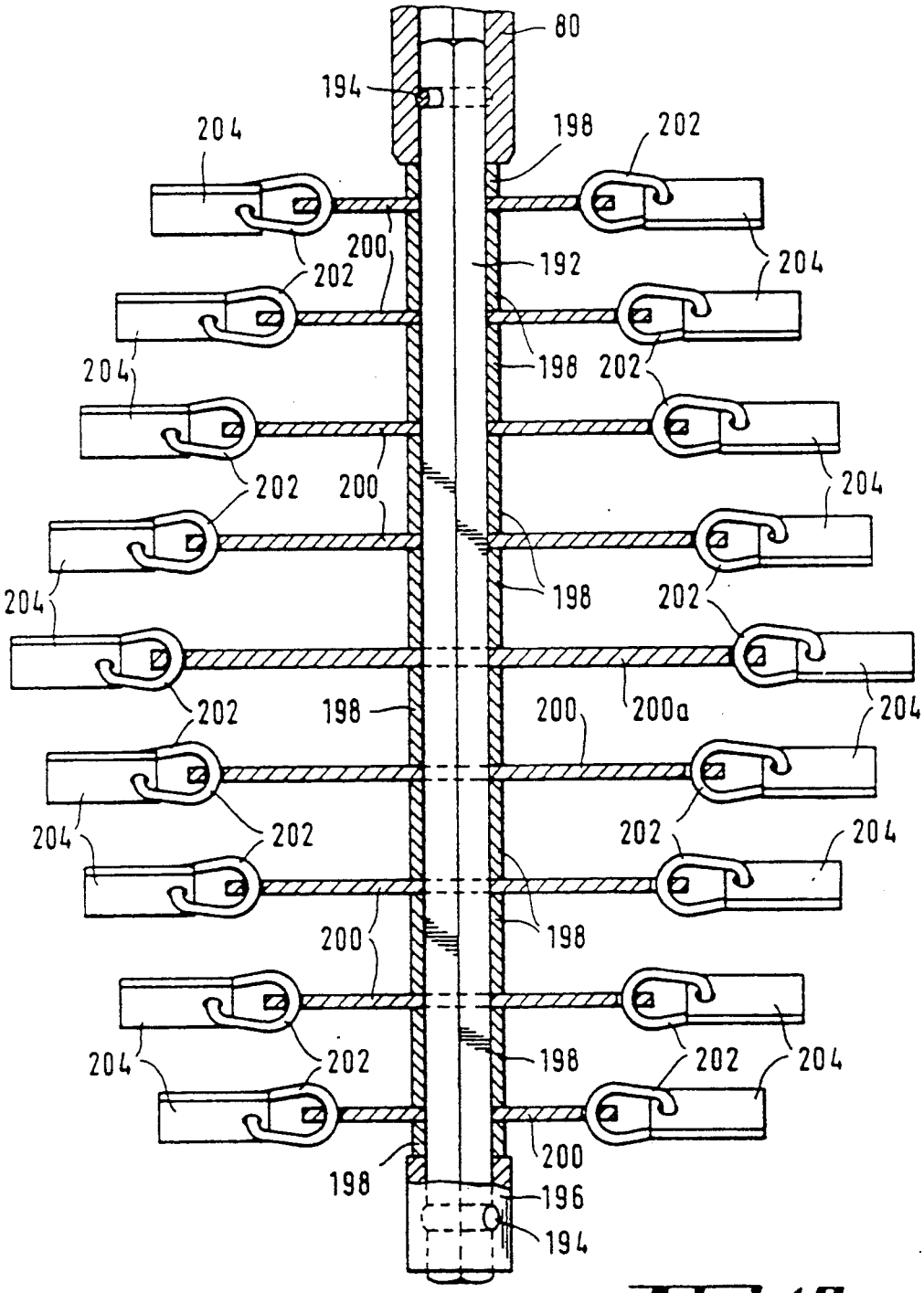
FIG. 13, an axial longitudinal sectional view of a preferred modification of the milling cutter employed in FIG. 1.
Figure 14:
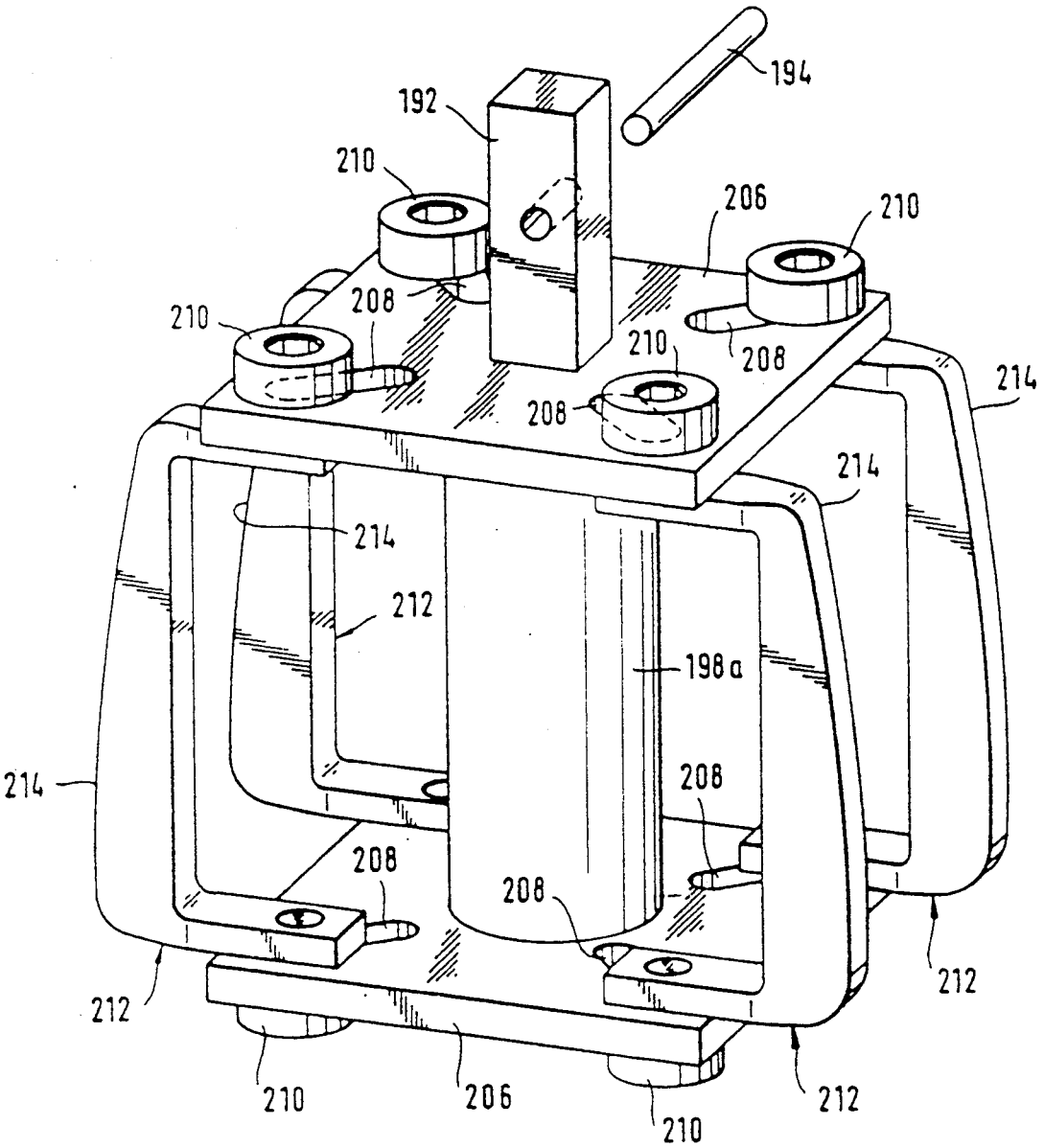
FIG. 14, a perspective view of the milling tool employed in FIG. 2.
Figure 15:
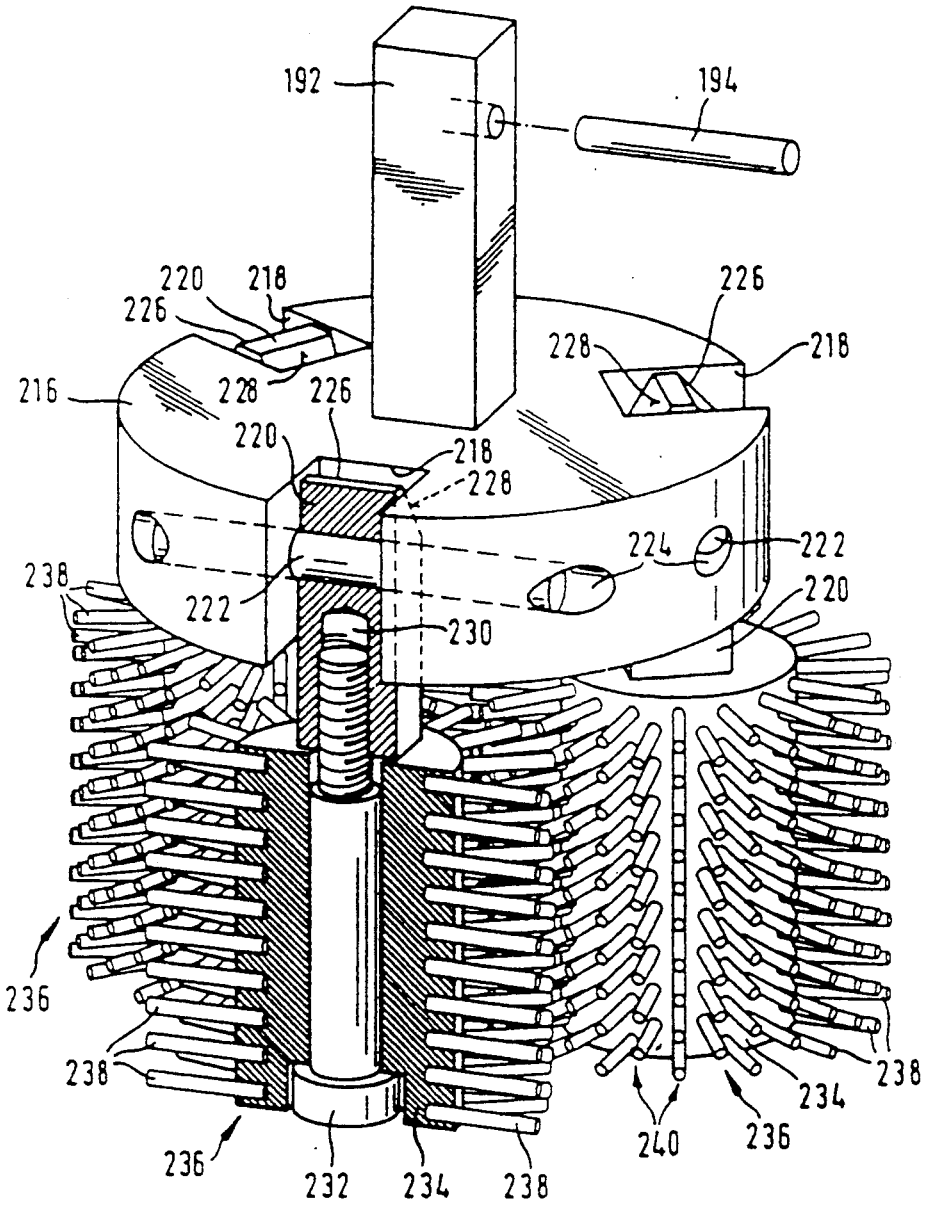
FIG. 15, a perspective view of the milling cutter employed in FIGS. 3 and 4.

FIGS. 13, 14 and 15 further show three particularly preferred milling cutter types that can be used in the apparatus according to the invention.

In all three cases, the milling cutter includes a central carrier body 192 around which extend the milling elements supported by the carrier body. The upper end of the carrier body is here shown to have a four-sided configuration, while the standard design would provide hexagons instead. By way of fastening pins 194 which engage in corresponding fastening bores in carrier body 192, these are rigidly fastened to the output shaft of the respective fluid motor 12 so as to be axially flush with its action axis. In the borderline case, fastening couplings which are slightly laterally bendable can also be provided which, however, should be able to absorb the torque acting in the angular direction.

In the case of the embodiment according to FIG. 13, carrier body 192 extends with unchanging cross section over the entire axial height of the milling element. The lower end is here configured as a support bearing 196 which is fastened to carrier body 192 by way of a fastening pin 194 in a manner secure against axial displacement.

Above the support bearing, a sequence of spacer sleeves 198 and spacer discs 200 are placed loosely onto the carrier body. Spacer discs 200 are here preferably arranged equidistantly, with spacer sleeves 198 disposed therebetween, all possibly having the same axial length and being identical. The lowermost spacer sleeve 198 may be shorter, as shown. In the alternative, the latter may be omitted entirely and the lowermost spacer disc may lie directly on support bearing 196.

The outer end of each spacer disc carries a single chain link 202 distributed over the circumference of the milling cutter, each link carrying a milling disc 204 at its outer end.

FIG. 13 depicts an arrangement in which it is assumed that the milling cutter is in the rotating state so that the outer chain links 202 which are articulated to spacer discs 200 as well as to milling discs 204 in the manner of a chain fly horizontally outwardly as shown also in FIG. 1 with respect to longer chain-like milling cutters. In the rest state, such chains hang downwardly under their own weight so that they can then be easily brought through not yet milled out regions of the chimney.

Seen from the top to the bottom, milling discs 204 describe an initially conically widening and then again conically tapering action cone which is designed to be axially symmetrical relative to the center spacer disc 200*a* so as to be able, with unchanging geometry, to mill in a double action mode toward the top as well as toward the bottom. Since the milling discs of the center spacer disc 200*a* are stressed the most, due to their largest radial projection, and therefore should advisably be selected to be particularly resistant, it is also recommended, as shown, to make the center spacer disc 200*a* stronger than the remaining spacer discs (thicker, if the material is the same). The spacer discs differ in radial width corresponding to the respective radial projection of the action cone at the respective location, while the individual chain links 202 may all be selected to be identical.

In the embodiment of a milling cutter according to FIG. 14, carrier body 192 is provided, as mentioned with respect to the above-described milling cutter, with a lower support bearing (not shown) analogous to support bearing 196 on which rests, in this case, a single, elongate spacer sleeve 198*a* (instead of the plurality of spacer sleeves 198 and spacer discs 200 in the above described embodiment).

Between the support bearing and spacer sleeve 198*a*, on the one hand, and on the upper end face of spacer sleeve 198*a*, on the other hand, there is disposed a carrier plate 206 which is connected with carrier body 192 in a manner secure against rotation, here in a square configuration.

In each of the four corner regions of this square carrier plate 206, there is provided a radially extending long hole 208 into which a set screw 210 engages from the side facing away from spacer sleeve 198*a*. Distributed over the circumference of the milling cutter, four stirrup-shaped cutting elements 212 are hinged to set screws 210 so as to be pivotal and, if set screws 210 are tightened, to be fixed in a certain angular position. Moreover, if the set screws are set to be sufficiently loose, a free axial displaceability may be provided for cutting elements 212 along long holes 208 in which case this displaceability is impossible again if the set screw is tightened.

Each milling cutter is provided with a cutting edge 214 on at least one exterior narrow side. It is also conceivable to provide a cutting edge 214 at both edges of the cutting element, with only one cutting edge at a time being in use in one working direction, be it for working under different operating conditions, be it for the purpose of reversed installation for the successive us of both cutting edges.

Or, in order to provide particularly advantageous milling conditions, the cross section of cutting element 212 may be selected in such a way that a cutting edge 214 is possible only at one edge.

The illustration in the drawing also shows the cutting edges 214 to be projecting radially outwardly when seen axially from the top to the bottom again so as to describe a conical action cone. With the direction of work reversed, this workpiece can also be readjusted in that the arms of the stirrup-shaped cutting elements at which set screws 210 engage between carrier plates 206 are exchanged. In the alternative, a double action can be created in that the projection of the cutting elements themselves is selected in the manner of a double cone as this has been described already with reference to the embodiment of FIG. 13 and its various cutting elements. Here, the double cone would then be formed by the same cutting element. In the alternative, however, similar to the embodiment of FIG. 13, two cutter components of FIG. 14 may be connected axially in series and thus the projection that produces the double cone action cross section can be realized with identical cutting elements which, however, project differently at the top and bottom. As an alternative to the particularly preferred described embodiment including long holes 208 and set screws 210, the stirrup-shaped cutting blades may also simply be individual chain links as this is described in the embodiment according to FIG. 13 with respect to the connection of spacer discs 200 in that figure with the outer cutting discs 204 and the individual chain links 202.

In the third embodiment of a preferred milling cutter shown in FIG. 15, a support disc 216 is fastened to the lower end of carrier body 192 in a manner similar to the earlier described support bearing 196, e.g. by means of a fastening screw (not shown) with which support disc 216 is screwed from the bottom onto carrier body 192 which form-lockingly partially engages in support disc 216.

Three axially continuous rectangular grooves 218, equidistant in the circumferential direction, are distributed over the circumference of support disc 216. Each rectangular groove 218 accommodates a swing block 220 which forms a short linear lever and essentially takes up the width of the rectangular groove while being movable relative thereto. Block 220 is articulated so as to pivot about a hinge pin 222. Hinge pin 222 is hammered in, in a form locking manner, through passage bores 224 disposed at both sides of the respective rectangular groove 218.

The swing blocks are essentially flush with the upper end face of support disc 216. Further, the upper ends of swing blocks 220 are sloped in the manner of a roof at least at the radially inner side of the milling head. The drawing figure shows a roof 226 which is identical toward the outside and the inside and has a planar top. Once swing block 220 has taken up the pivoted position, the rooftop is here essentially flush with the surface of support disc 216 while the radially inwardly disposed roof slope 228, in a predetermined pivoted-out position of swing block 220 abuts at the bottom of rectangular groove 218 and thus delimits the pivoting movement. The double-sided roof configuration can be employed to reverse the installation direction if the swing block is worn on one side.

At the lower end of the swing block 220 which projects axially downwardly out of support disc 216, there is provided a threaded bore 230. A highly stress resistant stay rod 232 is tightly screwed into this bore and serves, with some radial play, as the bearing shaft for the cylinder shell shaped basic body 234 of a milling head 236. The milling head is here complemented by milling pins 238 which are rigidly inserted into the cylindrical circumferential face of basic body 234 and project radially from this circumferential face so that basic body and milling pins together form something similar to a radial porcupine. The milling pins all have the same length so that the circumferential face of the porcupine describes a cylindrical, possibly also some other envelope face, e.g. an envelope face which is slightly convex in the middle of its axial length. The pins themselves are linear and made of a hard metal, e.g. a steel alloy or other hard metals or hard metal alloys.

As can be seen from the arrangement of the bores in adjacent axial rows 240 of receiving holes in the circumferential face of the basic body for milling pins 238, the receiving holes of these rows are offset to the gaps between the holes in the other row, with all rows being equidistant.

The bearing for the basic bodies 234 of milling heads 236 on stay rods 232 with some play is provided by a loose joint which may possibly also have a different configuration. It has been found that the hard stresses on such a milling cutter are absorbed better when a chimney is laid out so that the milling head is arranged somewhat loosely on its bearing shaft than if the bearing were precise.

The head of the respective stay rod 232 is inserted, as shown, into the basic body at its outer frontal face.

As was shown in FIGS. 3 and 4, this tool, with unchanged geometry, may be used to work downward as well as upward, with possibly a carrier body 192 being provided at both end faces of support disc 216. This has not been realized in the embodiment of FIG. 15. In the illustrated embodiment, the swing blocks 220 which act as linear pivot arms are able to hang vertically downward in a freely swinging manner if the milling cutter is not rotating. Then the outer envelope faces of the three milling heads 236 are supported against one another in such a manner that all three milling heads are essentially axially aligned and thus it is easily possible to introduce them into a not yet milled out chimney cross section. In the alternative, the swing blocks in this mode of operation ma also be allowed to have their interior longitudinal face come in contact with the bottom of rectangular groove 218. Additionally, the bottom of the "rectangular" groove may also be made convex so as to possibly hold the swing block somewhat axially.

However, due to its geometry, the illustrated embodiment does not permit a double-action mode of operation without relocating the carrier bodies 192 provided on both sides for fastening them to the drive shaft of fluid motor 12.

In a manner not illustrated, however, the stop for swing block 220 may be configured to be releasable at the bottom of rectangular groove 218 by means of a servo device so that it is possible to swing the swing block out of the suspended arrangement according to FIG. 15 into an essentially upright arrangement to be fixed there by means of an external support possibly also adjustable by means of a servo device. Such a servo control may again be effected by means of the same operating medium employed for operation of fluid motor 12, but through a separate control line.

Figure 16:
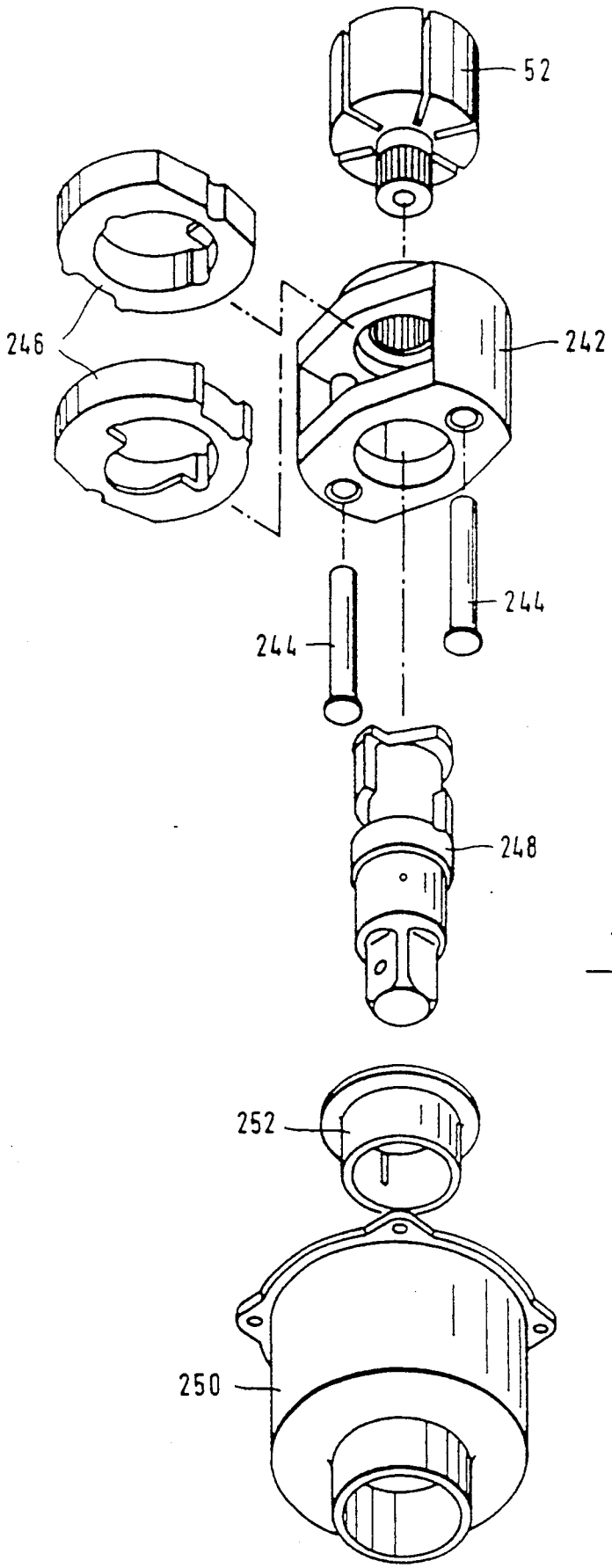
FIG. 16, an expositional view of a compensatory striking mechanism preferably disposed between the fluid motor and its suspension, but possibly also in the region of the output shaft of the fluid motor.
Figure 17:
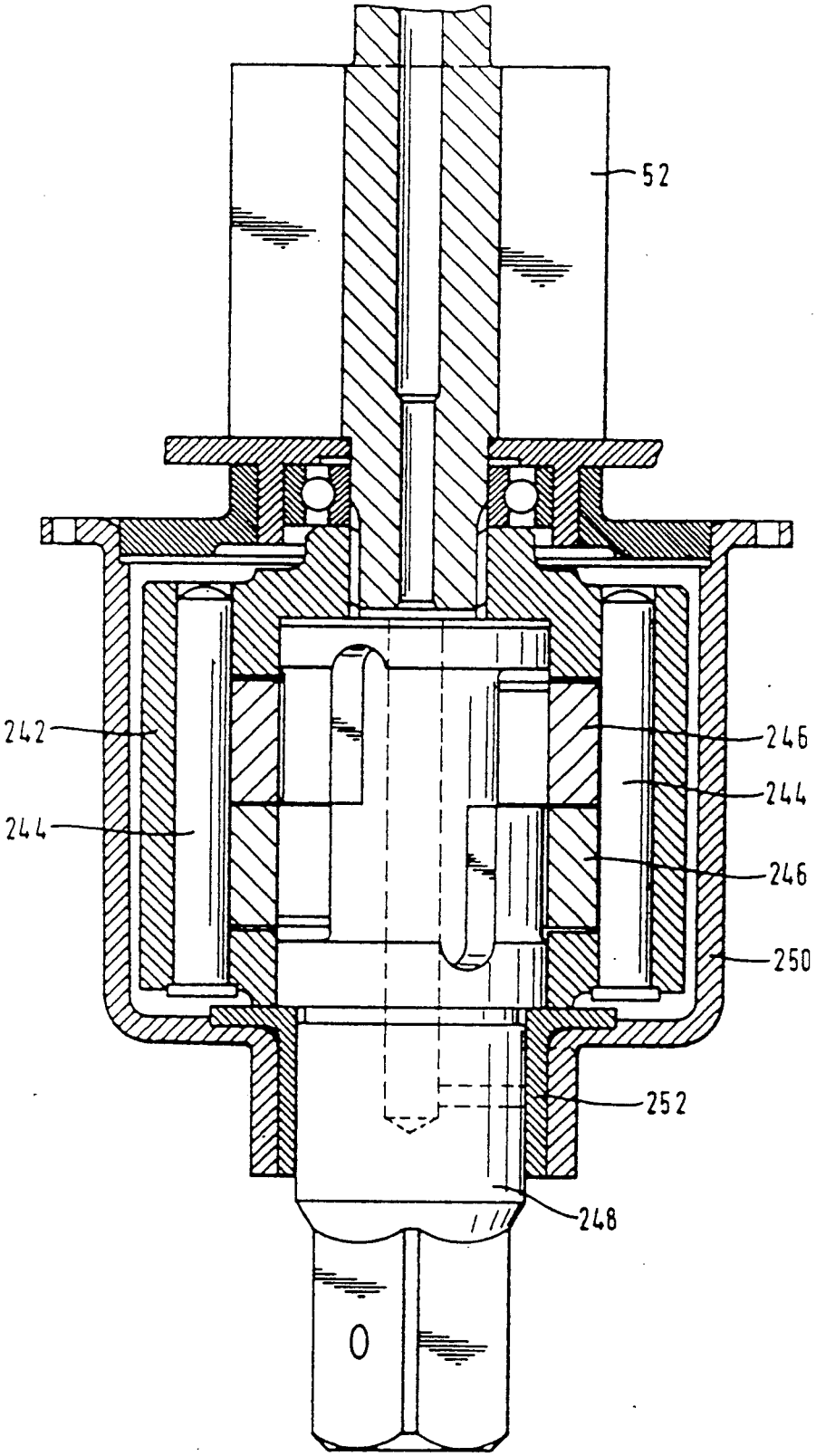
FIG. 17, an axial longitudinal sectional view of this striking mechanism.

Finally, essential operational elements of a commercially available striking mechanism will be described with reference to FIGS. 16 and 17. This striking mechanism superposes a pulsating striking movement in the angular direction on the angular rotation of the drive shaft of the fluid motor, here specifically a pneumatic motor, with the same striking sequence being repeated per drive shaft revolution. In a manner not shown, the striking operation may be added only once a desired number of revolutions has been reached so as to make available, for example, softer start up processes.

Although such a striking mechanism may also be arranged at another location, particularly between the fluid motor and its suspension, it will be described below in an arrangement in which it directly follows the rotor of the fluid motor. Insofar it replaces a separate step-down gear in that the amplification of the torque of a step-down gear is exchanged for an increased effect from hammering. However, if necessary, torque reinforcement from step-down gears and hammering effect by means of the striking mechanism may also be combined.

A hammer carrier 242 of the striking mechanism is driven by the rotor 52 of the pneumatic motor at a transmission ratio of 1:1.

Within hammer carrier 242, two hammers 246 and two hammer pins 244 are loosely arranged at diametrally opposite circumferential locations, with hammer pins 244 radially outwardly limiting movement of hammers 246 under centrifugal force.

During the rotational movement of hammer carrier 242, hammers 246 are carried along in the direction of rotation. The arrangement of hammers 246 in hammer carrier 242 is different which is evident by differences in circumferential length of circumferential grooves for accommodating the hammers and a different geometry of the grooves. Rotation of the hammer carrier causes hammers 246 to perform a tumbling movement.

Hammers 246 strike in the direction of rotation and cooperate with an anvil 248 which forms a preferably rigid unit secured against rotation with output shaft 80 carrying the milling cutter 16. Anvil 248 is here mounted in striking mechanism housing 250 by way of a bearing bush 252. Thus output shaft 80 also is given a uniform support.

The different arrangement of hammers 246 in hammer carrier 242 is designed in such a manner, in spite of their differences, so that both hammers 246 strike anvil 248 simultaneously.

I claim:

1. An apparatus for cross-sectionally enlarging a chimney flue to be lined, comprising (a) a fluid motor having a motor axis;

(b) a milling center mounted on said fluid motor and operatively connected to said fluid motor to be driven thereby for removing constructional wall material from walls defining the flue;

(c) suspension means for supporting the fluid motor and the milling cutter as a unit and for raising and lowering the fluid motor and the milling cutter in the chimney flue;

(d) a fluid pressure source;

(e) a hose connecting said fluid pressure source with said fluid motor for supplying the fluid motor with pressurized fluid from said fluid pressure source;

(f) guiding means arranged about and travelling with said fluid motor for engaging the flue walls to guide the fluid motor in the flue; and (g) means for varying a radial position of said guiding means relative to said motor axis.

2. An apparatus as defined in claim 1, wherein said guide means comprises runners extending parallel to said motor axis and said means for varying a radial position includes adjusting means for adjusting distances between said motor axis and said runners.

3. An apparatus as defined in claim 2, wherein said adjusting means includes fluid control means.

4. An apparatus as defined in claim 2, wherein said adjusting means includes pneumatic control means.

5. An apparatus as defined in claim 1, wherein said fluid motor has a circumference, further wherein said guiding means comprises at least two axially spaced ring assemblies; each ring assembly including resilient guide elements distributed about said circumference.

6. An apparatus as defined in claim 5, wherein each said guide element has a lever; further comprising pivot means for pivotally securing each lever to said fluid motor; each said ring assembly further comprising an elastically yielding buffer element mounted on said fluid motor axially spaced from said pivot means for abutting the levers of respective said ring assemblies.

7. An apparatus as defined in claim 5, wherein at least one of said guide elements comprises a rotatably mounted guide roller for engaging a flue wall.

8. An apparatus as defined in claim 5, further wherein at least one of said guide elements comprises a rotatably mounted cutting wheel for engaging a flue wall.

9. An apparatus as defined in claim 1, wherein said fluid motor comprises a pneumatic motor, said hose is a conduit for compressed air and said fluid pressure source comprises a compressor.

10. An apparatus as defined in claim 9, wherein said pneumatic motor has an exhaust opening oriented towards said milling cutter.

11. An apparatus as defined in claim 10, wherein said guiding means comprises runners extending parallel to said motor axis and means for guiding the fluid motor during travel in either direction in the chimney flue; and further wherein said means for varying a radial position includes adjusting means for adjusting distances between said motor axis and said runners.

12. An apparatus as defined in claim 11, wherein said hose constitutes said suspension means.

13. An apparatus as defined in claim 11, wherein said fluid motor comprises a pneumatic motor having an exhaust opening oriented towards said milling cutter; and further wherein said hose is a conduit for compressed air and said fluid pressure source is a compressor.

14. An apparatus as defined in claim 13, wherein said hose constitutes said suspension means.

15. An apparatus as defined in claim 11, wherein said adjusting means includes pneumatic control means.

16. An apparatus as defined in claim 15, wherein said hose constitutes said suspension means.

17. An apparatus as defined in claim 15, wherein said fluid motor comprises a pneumatic motor having an exhaust opening oriented towards said milling cutter; and further wherein said hose is a conduit for compressed air and said fluid pressure source is a compressor.

18. An apparatus as defined in claim 17, wherein said hose constitutes said suspension means.

19. An apparatus as defined in claim 1, wherein said suspension means consists of an element capable of transmitting solely a traction force.

20. An apparatus as defined in claim 19, wherein said hose constitutes said suspension means.

21. An apparatus as defined in claim 1, wherein said fluid motor has a rotor; further comprising a step-down gear operatively connecting said rotor with said milling cutter.

22. An apparatus as defined in claim 21, wherein said step-down gear is a multi-stage step-down gear.

23. An apparatus as defined in claim 21, wherein said step-down gear is a planetary gear.

24. An apparatus as defined in claim 1, wherein said milling cutter has a rotary axis and includes circumferentially distributed cutting elements extending along the rotary axis; each cutting element having an outwardly oriented narrow side and a cutting edge disposed at said narrow side.

25. An apparatus as defined in claim 24, wherein said milling cutter has a working direction of travel; further wherein the cutting edges diverge radially from the rotary axis in a direction opposite said working direction of travel.

26. An apparatus as defined in claim 24, wherein said milling cutter has a carrier; further comprising means for articulating the cutting elements to said carrier.

27. An apparatus as defined in claim 26, further comprising means for immobilizing the cutting elements in a desired position relative to said carrier.

28. An apparatus as defined in claim 24, wherein said milling cutter has a carrier; further comprising means for radially movably securing said cutting elements to said carrier.

29. An apparatus as defined in claim 28, further comprising means for immobilizing the cutting elements in a desired position relative to said carrier.

30. An apparatus as defined in claim 1, wherein said milling cutter has a rotary axis and includes axially spaced groups of chains.

31. An apparatus as define din claim 1, wherein said milling cutter comprises (a) a rotary shaft defining a rotary axis;

(b) a plurality of axially spaced spacer discs mounted on said rotary shaft concentrically and perpendicularly relative to said rotary axis;

(c) a plurality of single-link chains articulated to an outer marginal zone of each said spacer disc; each said chain having an outer cutting edge.

32. An apparatus as defined in claim 31, wherein said milling cutter has a working direction of travel and further wherein said spacer discs have different diameters such that the spacer discs fit into an imaginary cone being coaxial with said rotary axis and widening in a direction opposite to said working direction of travel.

33. An apparatus as defined in claim 31, further wherein said spacer discs have different diameters such that the spacer discs fit into a base-to-base arranged imaginary dual cone being coaxial with said rotary axis.

34. An apparatus as defined in claim 1, wherein said milling cutter has a rotary axis and a working direction of travel; said milling cutter comprises (a) a support disc held coaxially with and perpendicularly to the rotary axis;

(b) a plurality of generally axially oriented arms each having a first end oriented in said working direction of travel and an opposite second end; said arms having a pivot connection with said support disc at said first end and being distributed about said rotary axis;

(c) separate milling heads attached to each arm at the second end thereof; and (d) projecting milling pins carried on each said milling head on a circumferential surface thereof.

35. An apparatus as defined in claim 34, wherein each arm is swingable about said pivot connection between a position parallel to the rotary axis and a predetermined inclination to the rotary axis.

36. An apparatus as defined in claim 35, further comprising means for arbitrarily setting said predetermined inclination.

37. An apparatus as defined in claim 34, wherein said milling heads are cylindrical.

38. An apparatus as defined in claim 34, wherein said arms have a length dimension and each milling head has an axis generally coinciding with said length dimension; on each said milling head said pins being arranged in rows oriented parallel to the milling head axis; said rows being distributed about said circumferential surface; said pins belonging to adjoining rows being staggered relative to one another along a circumference of each said milling head.

39. An apparatus as defined in claim 34, wherein said projecting milling pins have identical lengths.

40. An apparatus as defined in claim 39, wherein said milling cutter is structured for milling operation during travel thereof in either direction in the chimney flue.

41. An apparatus as defined in claim 34, wherein said arms have a length dimension and each milling head has an axis generally coinciding with said length dimension; further wherein said milling pins project radially relative to the respective milling head axes.

42: An apparatus as defined in claim 1, further comprising a shaft driven by said fluid motor; further wherein said milling cutter is divided into a first and a second partial tool; said first partial tool being mounted on said fluid motor and said second partial tool being mounted on said shaft; further comprising a rotary coupling connecting said hose to said fluid motor.

43. An apparatus as defined in claim 1, wherein said milling cutter is composed of insertable structural elements for milling operation in either direction of rotation.

44. An apparatus as defined in claim 43, wherein said milling cutter has a double-action geometry.

45. An apparatus as defined in claim 1, wherein said guiding means includes means for guiding the fluid motor during travel in either direction in the chimney flue.

46. An apparatus as defined in claim 1, further comprising a striking mechanism disposed between the fluid motor and the milling cutter; said striking mechanism being active in an angular direction.

47. An apparatus as defined in claim 46, wherein said striking mechanism forms a removable axial extension.

48. An apparatus as defined in claim 47, further comprising a step-down gear operatively connected between the fluid motor and the striking mechanism.

49. An apparatus as defined in claim 46, wherein said fluid motor is connected with a 1:1 transmission ratio to said striking mechanism and further wherein said striking mechanism is connected with a 1:1 transmission ratio to said milling cutter.

50. An apparatus as defined in claim 46, further comprising means for automatically switching on said striking mechanism when an rpm of said milling cutter reaches a predetermined limit value.

51. An apparatus as defined in claim 1, further comprising a compensating striking mechanism connected between said fluid motor and said suspension means.

52. An apparatus as defined in claim 1, further comprising a quick-release coupling connecting the fluid motor to said milling cutter.

53. An apparatus as defined in claim 1, wherein said milling cutter has a working direction, further comprising means for reversing the working direction of said milling cutter.

54. An apparatus for cross-sectionally enlarging a chimney flue to be lined, comprising (a) a fluid motor;

(b) a milling cutter mounted on said fluid motor and operatively connected to said fluid motor to be driven thereby for removing constructional wall and material from walls defining the flue; said milling cutter having (1) a rotary shaft defining a rotary axis;

(2) a plurality of axially spaced spacer discs mounted on said rotary shaft concentrically and perpendicularly relative to said rotary axis;

(3) a plurality of single-link chains articulated to an outer marginal zone of each said spacer disc; each said chain having an outer cutting edge;

(c) means for supporting the fluid motor and the milling cutter as a unit and for raising and lowering the fluid motor and the milling cutter in the chimney flue;

(d) a fluid pressure source; and (e) a hose connecting said fluid pressure source with said fluid motor for supplying the fluid motor with pressurized fluid from said fluid pressure source.

55. An apparatus as defined in claim 54, wherein said milling cutter has a working direction of travel and further wherein said spacer discs have different diameters such that the spacer discs fit into an imaginary cone being coaxial with said rotary axis and widening in a direction opposite to said working direction of travel.

56. An apparatus as defined in claim 54, further wherein said spacer discs have different diameters such that the spacer discs fit into a base-to-base arranged imaginary dual cone being coaxial with said rotary axis.

57. An apparatus for cross-sectionally enlarging a chimney flue to be lined, comprising (a) a fluid motor;

(b) a shaft driven by said fluid motor;

(c) a milling cutter mounted on said fluid motor and operatively connected to said fluid motor to be driven thereby for removing constructional wall material from walls defining the flue; said milling cutter being divided into a first and a second partial tool; said first partial tool being mounted on said fluid motor and said second partial tool being mounted on said shaft;

(d) means for supporting the fluid motor and the milling cutter as a unit and for raising and lowering the fluid motor and the milling cutter in the chimney flue;

(e) a fluid pressure source;

(f) a hose connecting said fluid pressure source with said fluid motor for supplying the fluid motor with pressurized fluid from said fluid pressure source; and (g) a rotary coupling connecting said hose to said fluid motor.

58. An apparatus for cross-sectionally enlarging a chimney flue to be lined, comprising (a) a fluid motor;

(b) a milling cutter mounted on said fluid motor and operatively connected to said fluid motor to be driven thereby for removing constructional wall material from walls defining the flue;

(c) means for supporting the fluid motor and the milling cutter as a unit and for raising and lowering the fluid motor and the milling cutter in the chimney flue;

(d) a fluid pressure source;

(e) a hose connecting said fluid pressure source with said fluid motor for supplying the fluid motor with pressurized fluid from said fluid pressure source; and (f) a striking mechanism disposed between the fluid motor and the milling cutter; said striking mechanism forming a removable axial extension and being active in an angular direction.

59. An apparatus as defined in claim 58, further comprising an step-down gear operatively connected between the fluid motor and the striking mechanism.

60. An apparatus as defined in claim 58, wherein said fluid motor is connected with a 1:1 transmission ratio to said striking mechanism and further wherein said striking mechanism is connected with a 1:1 transmission ratio to said milling cutter.

61. An apparatus as defined in claim 58, further comprising means for automatically switching on said striking mechanism when an rpm of said milling cutter reaches a predetermined limit value.

* * * * *